US007248231B2

(12) United States Patent
Hurley et al.

(10) Patent No.: US 7,248,231 B2
(45) Date of Patent: Jul. 24, 2007

(54) INTEGRATED INFORMATION PRESENTATION SYSTEM WITH ENVIRONMENTAL CONTROLS

(75) Inventors: Gerald C. Hurley, Silver Spring, MD (US); Earle H. Andrews, Midlothian, TX (US); Edward F. Lamb, Bethlehem, PA (US); Francis B. Lamb, Easton, PA (US)

(73) Assignee: Speakeasy, LLC, Silver Spring, MD (US)

( * ) Notice: Subject to any disclaimer, the term of this patent is extended or adjusted under 35 U.S.C. 154(b) by 401 days.

(21) Appl. No.: 10/700,587

(22) Filed: Nov. 5, 2003

(65) Prior Publication Data

US 2004/0090424 A1 May 13, 2004

Related U.S. Application Data

(60) Provisional application No. 60/423,567, filed on Nov. 5, 2002.

(51) Int. Cl.
*G09G 5/00* (2006.01)
*H04Q 7/20* (2006.01)

(52) U.S. Cl. ..... 345/2.1; 455/463

(58) Field of Classification Search ..... 345/156, 345/87, 1.1–3.4, 168–169; 455/463, 454
See application file for complete search history.

(56) References Cited

U.S. PATENT DOCUMENTS 3,936,109 A 2/1976 Richardson
4,092,785 A 6/1978 Forsman
4,255,872 A 3/1981 Williams, Sr.
4,459,114 A * 7/1984 Barwick ..... 434/307 R
4,561,740 A 12/1985 Vanderwerf
4,735,469 A 4/1988 Liggett
4,876,657 A 10/1989 Saito et al.

(Continued)

FOREIGN PATENT DOCUMENTS

EP 0 286 413 A2 10/1988
WO WO 97/41502 11/1997

OTHER PUBLICATIONS

International Search Report, Date of Mailing Jun. 2, 2004.

(Continued)

*Primary Examiner*—Amr A. Awad
*Assistant Examiner*—Stephen Sherman
(74) *Attorney, Agent, or Firm*—Sheridan Ross P.C.; Jason H. Vick

(57) ABSTRACT

A system including environmental controls that at least enhance the experience of giving or viewing a presentation. Controls are available which enable the presenter to have direct control of the presentation environment. Presenters can also practice a presentation before actually giving it, transmit a presentation, either pre-recorded or live, from a remote location(s), record a presentation for later distribution, view a pre-recorded or live presentation from a remote location(s), or upload a video or audio message to a website. The system also includes a stylus, a remote control, and an interface device to enable a handheld computing device to be used as a remote, or even as the source for presentations themselves. The system includes a combination of an Integrated Information Presentation Device (PowerPodium), an Integrated Presentation Environment Assembly with Controls (Presentation Booth), an Information Display Device System (PDA Device), a stylus and a remote control.

27 Claims, 13 Drawing Sheets

U.S. PATENT DOCUMENTS 4,991,219 A 2/1991 Isenhath
4,995,018 A 2/1991 Edwards
5,087,010 A 2/1992 Walters
5,123,874 A 6/1992 White, III
5,373,333 A * 12/1994 Kawada et al. ..... 353/122
5,428,417 A 6/1995 Lichtenstein
5,477,282 A 12/1995 Moore
5,525,765 A 6/1996 Freiheit
5,539,658 A 7/1996 McCullough
5,554,828 A 9/1996 Primm
5,594,859 A 1/1997 Palmer et al.
5,606,344 A * 2/1997 Blaskey et al. ..... 715/500.1
5,682,695 A 11/1997 Hoffman
5,719,622 A 2/1998 Conway
5,745,711 A 4/1998 Kitahara et al.
5,748,183 A 5/1998 Yoshimura et al.
5,767,897 A 6/1998 Howell
5,790,084 A 8/1998 Hix et al.
5,822,525 A 10/1998 Tafoya et al.
5,826,962 A 10/1998 Rodriguez, Jr.
6,035,350 A 3/2000 Swamy et al.
6,064,668 A 5/2000 Brown
6,084,582 A 7/2000 Qureshi et al.
6,091,408 A 7/2000 Treibitz et al.
6,092,885 A 7/2000 James
6,094,197 A 7/2000 Buxton et al.
6,108,001 A 8/2000 Tuttle
6,137,794 A 10/2000 Brown
6,160,907 A 12/2000 Robotham et al.
6,184,788 B1 2/2001 Middlemiss et al.
6,186,630 B1 2/2001 Miyashita
6,215,498 B1 4/2001 Filo et al.
6,215,915 B1 4/2001 Reyzin
6,216,158 B1 4/2001 Luo et al.
6,226,615 B1 5/2001 Kirby et al.
6,232,947 B1 5/2001 Miyawaki et al.
6,252,720 B1 6/2001 Haseltine
6,317,044 B1 11/2001 Maloney
6,326,883 B1 12/2001 Whitehead et al.
6,386,985 B1 5/2002 Rackham
6,411,988 B1 * 6/2002 Tafoya et al. ..... 709/204
6,452,612 B1 9/2002 Holtz et al.
6,504,706 B2 * 1/2003 Stewart ..... 361/681
6,626,543 B2 * 9/2003 Derryberry ..... 353/119
2001/0003479 A1 * 6/2001 Fujiwara ..... 353/122
2003/0005092 A1 * 1/2003 Nelson et al. ..... 709/220
2003/0043110 A1 * 3/2003 Chaves et al. ..... 345/156
2003/0120849 A1 * 6/2003 Roslak et al. ..... 710/303
2003/0224807 A1 * 12/2003 Sinha et al. ..... 455/463

OTHER PUBLICATIONS

Written Opinion for International (PCT) Patent Application No. PCT/US03/34956, mailed Sep. 21, 2004.
International Preliminary Examination Report for International (PCT) Patent Application No. PCT/US03/34956, mailed Sep. 21, 2004.

* cited by examiner

INTEGRATED INFORMATION PRESENTATION SYSTEM WITH ENVIRONMENTAL CONTROLS

RELATED APPLICATION DATA

This application claims the benefit of and priority to U.S. Provisional Application Ser. No. 60/423,567, filed Nov. 5, 2002 entitled "POWER PODIUM PRESENTATION DISPLAY APPARATUS WITH ENVIRONMENTAL CONTROLS," which is incorporated herein by reference in its entirety.

BACKGROUND OF THE INVENTION

1. Field of the Invention

Aspects of the invention generally relate to presentation systems, and more particularly to presentation systems having associated controls that are at least capable of manipulating various aspects of the presentation environment.

2. Description of Related Art

Currently, whenever someone prepares to give a presentation at an unfamiliar venue, he or she must adapt quickly to the environment found at the location where the presentation will be made. Depending on the size of the conference facility, hotel, or other corporate building, the speaker may find a wide range of devices and functionality available. The speaker either will bring a laptop or use one provided by the facility, each of which may differ from a "standard" laptop (since there is no standard design for laptops). Once the speaker has the laptop or other computing device available, he or she must next determine the type of software available to use for the presentation. Although there are some software packages that are dominant in this area, they are by no means universal. The speaker must load the presentation onto the laptop, assuming the data storage media of the presentation file can be accommodated by the storage drives available on the laptop. Because the size of presentation files frequently exceeds the capacity of 3.5" inch floppy discs (1.44 MB), compact discs (CDs) typically prevail. If the speaker does not have the right media, some sort of transfer must take place—either a new medium is used or another computer is used to transfer the data to the presentation computer. At this point, the speaker must hope that the projector and video signal from the computer are compatible with each other, and tat they are correctly integrated. During the presentation, the speaker must rely on others to modify the environment at the appropriate times, e.g., someone to dim or raise the lights as presentations begin and end.

Additionally, when the speaker arrives at his hotel for his presentation, he or she often focuses (sometimes as if by surprise) on the need to practice the presentation before delivery. Not infrequently the speaker then calls the meeting organizer and asks if he or she can set up the presentation in the meeting room and make sure "everything is working OK." The meeting organizer dutifully calls the hotel conference services manager and begs for the meeting room (which may or may not be available) and suitable AV equipment. Note that an LCD projector can rent for a significant cost. The speaker only rarely has available a system by which he or she can videotape the presentation for practice.

Due to the variety of hardware choices, the energy invested in learning the equipment often causes a corresponding drop in the quality of the presentation. The hardware is often owned by the facility and therefore the energy invested in learning about it is only useful in the short-term.

SUMMARY OF THE INVENTION

An exemplary embodiment of the Integrated Information Presentation System With Environmental Controls aims to alleviate many of the problems associated with making presentations of all types, and making them easier to give and of a higher quality to receive. The Integrated Information Presentation System With Environmental Controls comprises a combination of an Integrated Information Presentation Device (also known as a PowerPodium), an Integrated Presentation Environment Assembly with Controls (also known as a Presentation Booth), a Personal Handheld Computing Device Presentation System to Interact with Various Projection Devices a stylus, and a remote control. With the Integrated Information Presentation System With Environmental Controls, every technical aspect of a presentation is capable of being enhanced, as well as providing the speaker an opportunity to enhance his or her skill in giving a presentation.

Applications for the Integrated Information Presentation System With Environmental Controls include, but are not limited to, enhancing speaker performance, enhancing audience experience, providing a mini production studio, providing a remote viewing station, viewing pre-recorded presentations, and providing a consistent experience for audiences in varied locations simultaneously or, for example, at different times. Other applications include, but are not limited to, residential applications such as remote family reunions, family history presentations, home movie presentations, birthday celebrations, or remotely configuring security measures. Additional applications include, but are not limited to, remote learning classes, virtual sports spectating, virtual tours, virtual tours of vacation spots, virtual tours of houses for sale, virtual small group meetings, remote religious worship experiences, remote auction bidding, and the like. It is to be appreciated that the application of such a system is rich and varied, covering almost any event where sight or sound is important.

A speaker can load the presentation on the Integrated Information Presentation Device, interfaced with the electronic devices in the room to the degree the facility desires, which allows him or her to control the environment of the speaker, the audience, even remote audiences. Using the stylus, a presenter can use both the hardware and software controls to navigate the presentation slides, adjust the environmental conditions, interact with an assistant behind the scenes without disturbing the audience, and even point to highlight items using the imbedded laser pointer, or the like. In addition, a robust remote control is described that provides virtually every possible function of the Integrated Information Presentation Device while allowing the presenter to move about the room. In addition, the Personal Handheld Computing Device Presentation System to Interact with Various Projection Devices allows the speaker to use a handheld computing device as, for example, a remote control and as a stand-alone substitute for the Integrated Information Presentation Device.

Using the Integrated Presentation Environment Assembly with Controls (also known as a Presentation Booth), the speaker can practice the presentation on, for example, identical equipment, or equipment configured to emulate to what is in the presentation room, without tying up a valuable facility resource. Because the Integrated Presentation Environment Assembly with Controls is compact, it can be located in low-traffic, sparsely used spaces of the facility.

Since the features and controls of the Integrated Information Presentation Device are rich and varied, the experience gained in becoming familiar with them will enhance the total experience of both presenter and audience.

In addition, the Integrated Presentation Environment Assembly with Controls may also function as a mini recording studio or broadcasting studio. The speaker may record a presentation using the Integrated Presentation Environment Assembly with Controls on video or other storage means to be distribute the presentation over electronic means such as the Internet, or copy the presentation to more permanent means such as a floppy, DVD or CD for distribution. The Integrated Presentation Environment Assembly with Controls may also be used to broadcast a live presentation as well.

An exemplary embodiment of the Integrated Information Presentation Device (also known as a PowerPodium) aims, for example, to alleviate many of the problems associated with making a presentation to an audience, and to provide a means by which the speaker can control many of the environmental variables affecting the presentation without the need for the assistance of another person. Although another person is preferred to help operate the message center, FIG. 1, item 2B, it is not necessary to have anyone other than the speaker involved for any other function once the Integrated Information Presentation Device is set up for the speaker.

An exemplary embodiment of the Integrated Information Presentation Device can be housed, for example, within a podium or lectern, or it may be a smaller unit capable of being transported and placed on a table, lectern, podium, or other apparatus as may be used by speakers while they present. The Integrated Information Presentation Device may be set up, for example, semi-permanently in one presentation room, or it may be moved from room to room to enable more flexibility to a conference center.

At its most general, the Integrated Information Presentation Device is concerned with displaying a speaker's presentation, and as such, utilizes the use of, for example, a display (such as, but not limited to, a flat-panel display), a long term storage device (such as, but not limited to, a magnetic hard drive), various temporary storage devices (such as, but not limited to, a floppy drive), controls to enable the speaker to change the presentation environment (such as, but not limited to, lighting), various transmission devices to relay the commands to external devices controlling the environment, and optional devices to relay information to the speaker. One exemplary embodiment of the Integrated Information Presentation Device would have two separable parts, a "Detachable Presenter Unit" and a "PowerPodium Central Unit." The "Detachable Presenter Unit" could contain all hardware integral to control the presentation and the environment as it is given. The "PowerPodium Central Unit" may be placed nearby (on the order of a few feet), but out of sight to provide a clean view for the audience. The "PowerPodium Central Unit" could have the hardware and software essential to the operation and processing of presentation software, message center, and other commands, as well as the removable storage interface devices. The two separable parts may be connected by electrical wire, fiber-optic cable, wireless technology, or some other communication technology.

Thus, when using the Integrated Information Presentation Device, a speaker may prepare a presentation and store the presentation on a removable storage medium. The speaker may take this removable storage medium to the conference center, lecture hall, or other presentation site that has an instance of the Integrated Information Presentation Device ready for use. The removable storage medium is then inserted into the appropriate slot, chamber, or other opening or cavity of the removable storage device (e.g. the 3½" floppy drive 45 if the presentation is stored on a 3½" floppy disk) located on the Integrated Information Presentation Device. The appropriate presentation software is then initialized and the data from the removable storage is read and optionally saved to the internal long-term storage device, for example, a hard drive. It should be appreciated that any means of transferring files, including but not limited to wireless transfer can be used to get presentation files onto the Integrated Information Presentation Device. Once this is done, the speaker may begin the presentation, or may come back later and begin the presentation. Alternatively, the Integrated Information Presentation Device may be set up with "Agenda File Organizer" software, particularly in meeting or conference settings in which there may be more than one speaker or presenter. The Agenda File Organizer software is software code (for example, a program, a module, a dynamically linked library, etc.) which displays file names from the speaker's removable storage medium and enables the technician, speaker, or other set-up person to copy the files into an appropriate folder or directory. The Agenda File Organizer software is also software code that runs as the interface for each speaker throughout the conference or other speaking event to quickly have his own files loaded into the presentation software. An exemplary purpose of the Agenda File Organizer software is to arrange the availability of presentation and other files in an orderly manner, in order to facilitate the quick and smooth transition from one presenter to another without interruption. The Agenda File Organizer software can be activated (or can be auto-activated) to run, for example, whenever a removable medium is inserted into the Integrated Information Presentation Device. While the Agenda File Organizer software may be used to enable speakers to load their own presentations, it is more likely that a technician from the conference facility would use this to set up the files needed for the day, week, or possibly even month. The agenda file organizer software files might include, but are not limited to, the agenda file organizer software code, modules, libraries, data files and command files, presentation files, speaker introduction files, advertisements, announcements to be displayed during breaks, pictures, text files, or files used to enhance the entire conference experience, not just the presentation. The Agenda File Organizer software may also contain information about the order and time of the presentations to "automatically" load the appropriate presentation at the appropriate time. The Agenda File Organizer software may also store preferences, for example, in a profile, concerning the environment setup the speaker prefers, if the speaker is a frequent user of that particular instance of the Integrated Information Presentation Device. Besides easing the transition between speakers, this would give, for example, each speaker the sense that the machine is set up "just for him" for the time of his presentation. The presentation file (and any other appropriate files) may be copied to an internal hard drive for later use, thereby enabling the speaker to "save" his presentation on the particular instance of the Integrated Information Presentation Device he will use, and to keep the removable media elsewhere as a "backup." While some computer users may not need such software, it may be desirable to have this available as an option for those speakers who are not as comfortable manually controlling this process. While performing this transfer, or at any point interaction with software is required, the user may use, if available, the keyboard, the touch screen, the stylus (active and/or passive) or the "Pointer Control Device." The "Pointer Control Device," for example a mouse or a trackball, can be used to control the user interface pointer in many software packages and operating systems.

Before beginning the presentation, the speaker may adjust the room environment using the various controls installed on the Integrated Information Presentation Device. In an exemplary embodiment of the Integrated Information Presentation Device, the speaker will have the ability to adjust the environment using such things as, but not limited to, lighting controls, window lighting controls, presentation screen controls, sound controls, microphone controls, temperature controls, and air flow controls. It is to be appreciated that any aspect of a presentation environment that can be altered by artificial means can be incorporated easily into the Integrated Information Presentation Device. The speaker can adjust the environment to the conditions he or she thinks are best for viewing the presentation. For example, the speaker may adjust the lighting level to be dim but not dark using the lighting controls, promote air circulation by adjusting the air flow controls to produce a low velocity breeze for the audience and adjust the temperature to 70 degrees Fahrenheit using the temperature controls. If a situation arises before, during, or after the presentation that needs immediate attention, the speaker has control of the situation at his fingertips. For example, the speaker can mute all sound output from the Integrated Information Presentation Device using the mute button to silence any high-pitch feedback that commonly occurs with sound systems, or mute all sound while people are entering and exiting the room. One possible embodiment of the Integrated Information Presentation Device will allow the "retrieval" of settings from a previously saved environment modification using the "Shortcut Mode Buttons." Thus, a speaker may set up an "exit" environment which provides full overhead light for people to see their way into or out of the presentation area, while turning off the input from all microphones and the output of all speakers. Another "saved" environment mode may be that for a general presentation which sets the temperature at an appropriate level, adjusts the air flow as appropriate, lowers the lights, turns on the audio speakers and the speaker's microphone, lowers the presentation screen, and lowers the window shades. Of course, once these modes are executed, minor adjustments can be made by the speaker using the appropriate controls on the face of the Integrated Information Presentation Device. The controls may act like a type of remote control that sends the appropriate signals to external devices, which have been installed in the conference center's wiring. These signals may be transmitted by, for example, Infrared Ports, RF Transceiver Ports, or other energy transmission means, wireless or otherwise. The external devices may act directly on the signals from the embedded buttons, or the devices may take their signals from a central transmission point, which is controlled by the processing unit. For instance, when the speaker moves the control on the Integrated Information Presentation Device to dim the lights, a signal may be sent from the Integrated Information Presentation Device to an external device, such as a "dimmer," previously installed in the conference center room's electrical circuit. This signal may come from the lighting control module directly, or it may be processed and sent from the processor and one of the output devices of the Integrated Information Presentation Device. The external device would respond in either case appropriately and dim the lights. This arrangement will, however, require the conference center to install such devices in its circuitry prior to the presentation (probably a long-term installation by professionals according to local electrical codes), although this may be as simple as having a regular three-way or dimmer switch installed. Alternatively, small temporary devices, not unlike timer plugs common in many homes, may be temporarily inserted in any non-permanent circuitry, for example, when a plug is inserted directly into a wall outlet. If multiple instances of the Integrated Information Presentation Device are to be used in close proximity, for example in a large conference room with multiple presentations occurring, there will need to be a way to distinguish between signals. If a conference center has purchased more than one Integrated Information Presentation Device, it may not desirable for the commands of one instance of the Integrated Information Presentation Device to be received by another device being used in another room. Thus, to prevent the lights in multiple conference rooms from being brightened when one speaker adjusts the light control on his instance of the Integrated Information Presentation Device, either the rooms must be shielded from the transmitted energy from another room, or the devices should have distinguishable or identifying signals. Two of the ways, for example, this may be accomplished are by varying the frequencies the individual Integrated Information Presentation Device send and receive, or by providing an identification string at the beginning of a command sequence (it should be appreciated that there are other methods as well).

Alternatively, software may optionally be included to allow a user or technician to bring up a table of stored settings for various situations, time of day, speakers, and events, from which a selection is made and the Integrated Information Presentation Device produces control signals to various external devices controlling aspects of the speaking environment. These stored profiles may be completely user definable, or they may be static settings, or some combination thereof. Additionally, files containing task queues may be used, where each task has an associated time or point of presentation, in order to provide some automation to the changing of settings during a presentation. In an extreme case, with all the appropriate files on hand with command queues, the giving of a presentation may be fully automated—even to the point of needing no live speaker. This may be desirable especially in venues such as, but not limited to, movie theaters, church sanctuaries, public meeting places, concert halls, stadiums, and historical venues.

Once the environment has been set according to the speaker's preference, the speaker may turn his or her attention to the presentation to be given. The Integrated Information Presentation Device will be running presentation software, loaded with the speaker's presentation that had been prepared and loaded at some earlier time. The presentation will begin and the speaker will see a "speaker's version" of the presentation (as is common in some currently popular presentation packages), while the audience views only the "presentation slide" format. This is accomplished, for example, by using the two monitor outputs of the Integrated Information Presentation Device. One of these outputs, for example, may be internal and connected to the primary display, as is common in many devices known as "laptop computers." The other output, usually, but not necessarily on the external surface of the Integrated Information Presentation Device, will be connected, for example, to an image projection unit by electromagnetic, optical, wireless, or other communication technology from the Integrated Information Presentation Device to the image projection unit (this may or may not be accomplished with a physical line). This projector will display the incoming video signal on the projection screen, for example, or some other surface provided that is conducive to watching presentations. In another alternative embodiment of the Integrated Information Presentation Device, two screens may be built into the Integrated Information Presentation Device, with one facing the speaker and the other facing the audience (this screen may be adjustable for various heights and angles). This alternative embodiment is especially useful for situations where very small groups are presented to, or where the speaker is often traveling quickly between small group presentations.

During the presentation for example, the speaker may stand at the podium to directly interact with the Integrated Information Presentation Device as he goes through his slides, or he may use a remote control unit to enable him to move about the audience while still controlling the presentation through the Integrated Information Presentation Device. If he chooses to stay at the podium, he may use the "Next slide" and/or "Previous slide" buttons to control paging of the presentation slides. He may also access pages on the Internet using software activated by pressing the "Internet" button. Using, for example, the built-in trackball, he can then, for example, choose a site from a list of favorites, follow a link displayed on the screen, or type in the address with the keyboard of a document on a site by selecting the "address bar" with the trackball or "tab" key. The speaker may, for example, swap the Internet browsing software and the presentation software using the two keys provided on the Integrated Information Presentation Device (marked "Internet" and "Presentation"). At any time the speaker may black out (or white out) the audience screen using the key provided to enable him to perform functions with the software with which he would not want to distract the audience. After the presentation, it may be that the speaker will be asked a question about a slide he has shown. The speaker can then use the "Slide Sorter View" button, which will black out the screen and open, for example, a "slide sorter" view as is found in some common presentation software. The speaker will be able to find the slide to which the question refers and select it for viewing on the main screen. Once the slide has been selected, the speaker enables the audience view by re-pressing the black out key (which reverses the operation performed when the slide sorter view button was pressed). A button with the capability of muting all sound output from the device to keep extraneous noise from being generated during breaks, or times where there is feedback from the microphones, may be included on the Integrated Information Presentation Device. Optionally, a clock to view the time of day, as well as a timer which can be set at the beginning of a presentation to show the time remaining in the current session may be included on the Integrated Information Presentation Device. Optionally, a stylus (which may be active or dumb) provides, for example, the means for the speaker to select items on a touch-sensitive screen (or other feedback screen), or to utilize the "mark-up" slide feature found in some presentation packages.

If, at any time, the speaker needs assistance from the conference center or audiovisual team, he or she may press the "Assistance Required Button," optionally designated by a red button marked with an "H" for "HELP." Alternatively, or additionally, if assistance is needed, the Assistance Required Button may send a message, for example via e-mail, to a predetermined person. This button will trigger an output response such as, for example, a signal to a remote device to alert a helper, technician, or other appropriate personnel at a designated place in the building that immediate assistance is needed in the conference room. Since this button should be protected from accidental activation, it may, for example, be equipped with a raised rim, a flip cover (not unlike sensitive controls used in airplanes), or both. Once activated, the signal should continue until the speaker deactivates it by means such as, but not limited to, pressing the button a second time, or until it is deactivated by means of the response by the conference or audio-visual team.

An assistant may be utilized to provide feedback to the speaker during the presentation using the Message Center. This assistant could be in another part of the presentation room with an interfacing device, such as but not limited to a computing device connected through the local intranet or network, a computing device connected through the Internet, a computing device connected through wireless technology, or other similar means, analyzing the presentation itself, looking for audience reactions, and determining the right emphasis of the material. This assistant could send messages such as, but not limited to, "Explain point 3 more thoroughly," "Don't forget to highlight X," "You are losing the audience's attention," or even "You are out of time!" Another use may be that of filtering questions at the end of a presentation, rather than having an open Q & A session. This would enable the assistant to take the most insightful and relevant questions, or the most common questions, and have the speaker address them, without the fear that some audience member might monopolize the time with an arcane point. This Message Center may be accomplished with such similar technology as, but not limited to, popular "Instant Messaging" software, e-mail software, or it may be a direct link from the assistant's the interfacing device to the speaker's (perhaps through a direct connection between the two computers, wireless technology, the Internet or through a server computer in the presentation facility). Questions before, during, or even after the presentation could be sent to the speaker (through the assistant and message center) from a handheld computing device, a cellular phone capable of sending text messages, a two-way pager type device, or any other device capable of transmitting a text message from one point to the appropriate channel to reach the speaker and/or the speaker's helper.

A remote control can also be used with the system. In particular, a remote with pointer activation button, pointer lens, lighting controls, previous slide button, next slide button, sound controls, microphone controls, Internet button, presentation screen button, time of day display, presentation time elapsed, and presentation time remaining is described. The remote control may be used by the speaker even if he or she remains at the podium, since the remote may contain a built-in laser pointer. This enables the speaker to point out specific items on the slide whether or not he or she is near the screen. One exemplary embodiment of the remote control has many of the function controls of the Integrated Information Presentation Device built into it. The signal from the remote control may be transmitted through wires, although it is more desirable to have the remote use wireless technology to allow more freedom to the speaker as he presents. The controls that may be built into the remote control include, but are not limited to, lighting controls, sound controls, microphone controls, "Internet" and "Presentation" swapping buttons, as well as "Next slide" and "Previous slide" controls. There may also be a time of day display, "presentation time elapsed", and "presentation time remaining" displayed on the remote control. These may be synchronized with the time displays on the Integrated Information Presentation Device (also known as PowerPodium) (which might have been accomplished, for example, when the remote control was in the Remote Control Storage Compartment of the Integrated Information Presentation Device, as the presentation is set up), although it may not be necessary to do anything more than have the speaker "synchronize" them himself. The remote control may also be configured to transmit commands to operate a VCR, if the speaker desires to use videotape in his presentation. These commands, for example, may be transmitted directly to the VCR (requiring the remote control to be set up to interact with the correct type of VCR, similar to store-bought replacement remotes), or they may be transmitted back to the PowerPodium Central Unit, where they would be processed, and the appropriate signal sent then to the VCR. It should be appreciated that any feature controls of the Integrated Information Presentation Device may be incorporated into the remote control.

Additionally, it should be appreciated that many of the controls of the Integrated Information Presentation Device may be implemented using software rather than hardware. For instance, many of the buttons on the top face of the Integrated Information Presentation Device may be implemented as software controls or buttons as images on the display 2—not unlike buttons and controls found in web pages, games, or productivity software. This may be implemented using a larger display screen (including, but not limited to, a touch-screen) which could occupy the bulk of the top surface of the Integrated Information Presentation Device. The actual design behind the scenes should make little difference to the user beyond whether he pushes a button or selects an image of one on the screen. The software implementation of these functions may require the processor to process these inputs before sending the appropriate signals to the desired device. This implementation may require far less hardware, but it may require a more sophisticated processing program.

Since numerous embodiments of the Integrated Information Presentation Device can access the Internet, a speaker may use the Integrated Information Presentation Device (using an instance of one such embodiment), for example, to set up an online viewing (remote viewing) of the conference speaker and his or her notes using the Internet access connection. Depending on the quality of video desired, one may set up, for example, a digital video camera (referred to in some embodiments as a "web-cam") to be connected to the Integrated Information Presentation Device to stream the signal to the web, or it may be necessary to set up an alternate connection to the web using a separate device, if the video quality desired is so high as to affect the processing of the presentation, and therefore the presentation itself.

Additionally, the speaker may desire to distribute the slides, using translation software integral to one embodiment of the Integrated Information Presentation Device, in a variety of languages that can be selected individually by members of the audience. The conference center or meeting facility may have installed server and terminal equipment in the presentation rooms in which this feature may be used. The terminals may comprise LCD screens and related equipment located on the seatbacks directly in front of the respective audience members, or in alternate configurations of the audience chairs, in which the terminals are linked to the Integrated Information Presentation Device via the server. An interface or network connection may be established by which the audience member connects his own laptop or personal digital assistant (PDA) to view the presentation in the alternate language format. Additionally, a human translator may be provided for every language appropriate to translate the words the speaker says during the presentation for audience member speaking that language. This translation may be disseminated using wireless communication devices as is common already in some venues, or it may be disseminated through data in the interface or network connection. It should be appreciated that as speech recognition programs become more sophisticated, and as translation programs develop, that these new features would be easily incorporated into the Integrated Information Presentation Device.

An exemplary embodiment of the Integrated Presentation Environment Assembly with Controls (also known as a Presentation Booth) aims, for example, to alleviate many of the problems associated with preparing for a presentation in an unfamiliar environment or using unfamiliar equipment. It also aims to provide a way for speakers to practice, record, or broadcast a presentation from a compact environment, rather than a classroom or meeting room. The Integrated Presentation Environment Assembly creates substantial benefit for, for example, the speakers, the audience members, the sponsoring organization, and the hosting facility.

The speaker now has an efficient, convenient and vastly improved system for practicing his or her presentation. For example, upon checking into the hotel, the speaker will receive an encoded card, prearranged by the sponsoring organization, which will gain him or her access to any available Integrated Presentation Environment Assembly with Controls (Presentation Booth) at the hotel. This eliminates unnecessary delay for the speaker and unnecessary staff cost for both the sponsoring organization and the hosting facility.

The audience will benefit from having speakers who are better prepared at giving a particular presentations and a better overall meeting experience because the Integrated Presentation Environment Assembly with Controls allows them to practice with the Integrated Information Presentation Device and all of its features before coming in to the lecture hall. Continued benefit to all will continue to be realized as the Integrated Information Presentation System with Environmental Controls becomes the standard for presenters.

The sponsoring organization, which often earns praise or criticism based upon the quality of presentations at its conferences, can look forward to speakers who are better prepared. As a result, the organization's customers—the meeting registrants—are happier and more likely to attend the same conference in future years.

The facility hosting the presentation is now able to provide a superior service to its customers, and can provide that improved service in a way that is more conserving of its personnel costs. The hotel now can be confident that the service will be available when the customer needs it, that it will be state of the art, and that it will eliminate the crisis atmosphere that frequently accompanies speaker preparation.

In addition, the Integrated Presentation Environment Assembly with Controls may be used as a recording studio to enable speakers to produce a presentation to be distributed through or to a website, various media formats, and even live-feeds to remote audiences.

Another use of the Integrated Presentation Environment Assembly with. Controls is for remote participation or viewing of presentations (conferences, seminars, and other events). An additional application of the Integrated Presentation Environment Assembly with Controls is to provide "virtual attendance" at an event (i.e. a baseball game), complete with sights, sounds, images (and even smells), while optionally providing feedback to the event, e.g., broadcasting a user's cheers to the appropriate area in the arena.

An exemplary embodiment of the Personal Handheld Computing Device Presentation System To Interact With Various Projection Devices aims to enable speakers to use their own handheld computing devices (with presentation software and data loaded onto the handheld computing device) in presentations in various places. This is especially ideal for the speaker who needs to travel light and frequently between various presentation sites. By enabling the speaker to use his own handheld computing device, the speaker will be capable of having a comfortable, intimate knowledge of the handheld computing, and thus will not need to be concerned with much else besides the presentation material in preparation. A transmitter attaches to the handheld computing device, interfacing with the communication port, which allows the handheld computing device to communicate with various projection devices through a receiver base. The transmitter and/or the receiver may be owned by either the conference center or the speaker, although it may be more advantageous to the speaker to have his own transmitter-receiver-handheld computing device set, since various implementations of Handheld Computing Devices are available, many with incompatible communication ports.

The personal Handheld Computing Device will contain the presentation software as well as all necessary presentation data files. The user, familiar with his own Handheld Computing Device and presentation software, will have little difficulty preparing to present, even if he or she is at an unfamiliar conference center. After attaching the transmitter to the Handheld Computing Device, the receiver base will receive the video signals from the transmitter and transmit them to the projector unit. The receiver base has interface ports for both sound and video. Once the minimal setup procedures are completed, the speaker can immediately start the presentation—ideal for keeping schedules on target.

A stylus may be provided to operate the touch-activated screen. Optionally, it may have a laser pointer.

These and other embodiments will be described in greater detail with reference to the following figures.

BRIEF DESCRIPTION OF THE DRAWINGS

Embodiments of the Integrated Information Presentation System with Environmental Controls and the corresponding component parts will now be described in detail, by way of example, with reference to the accompanying drawings, in which.

DETAILED DESCRIPTION

Figure 1:
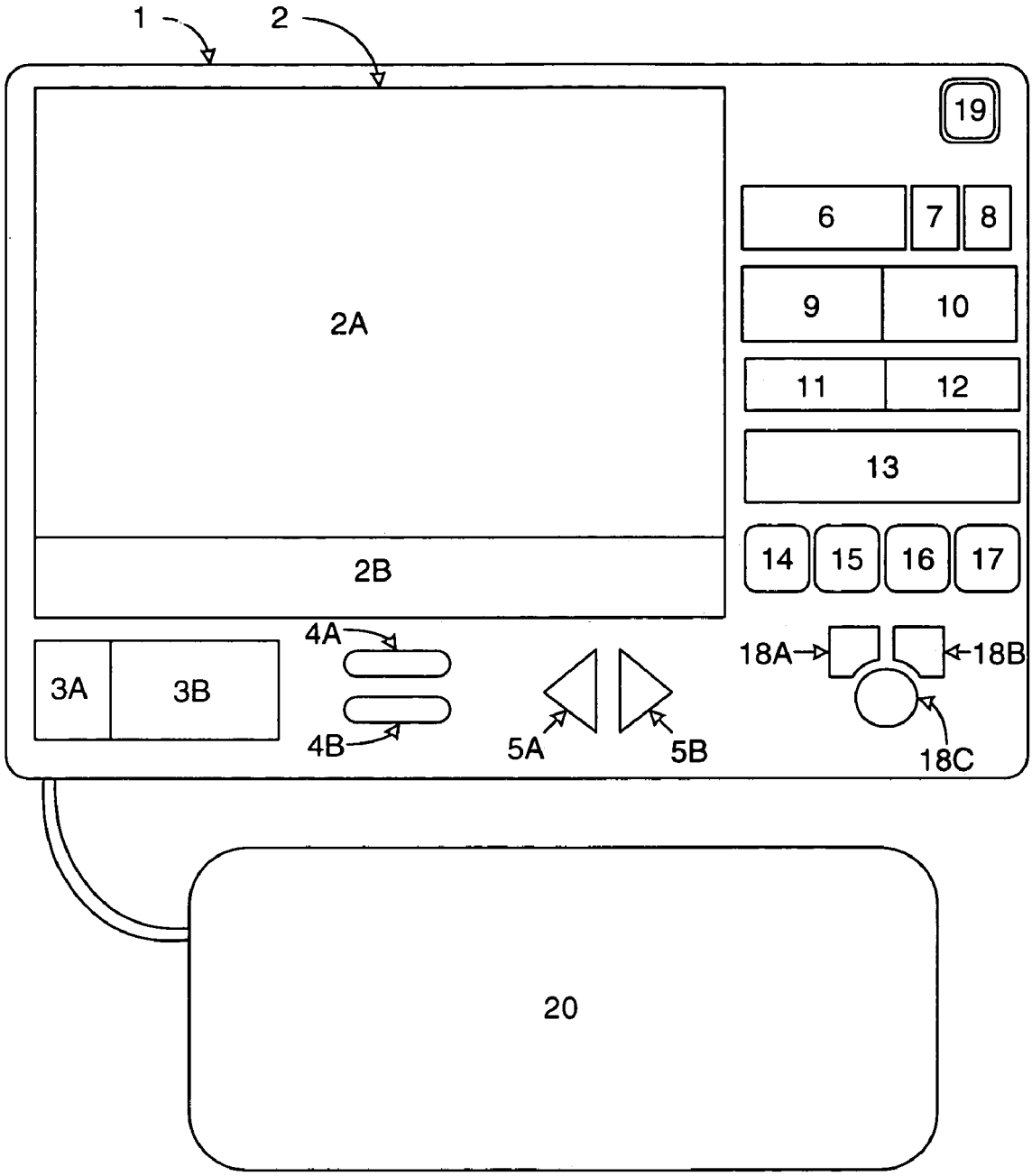
FIG. 1 illustrates a top view of one exemplary embodiment of the Integrated Information Presentation Device ("PowerPodium") according to this invention.
Figure 2:
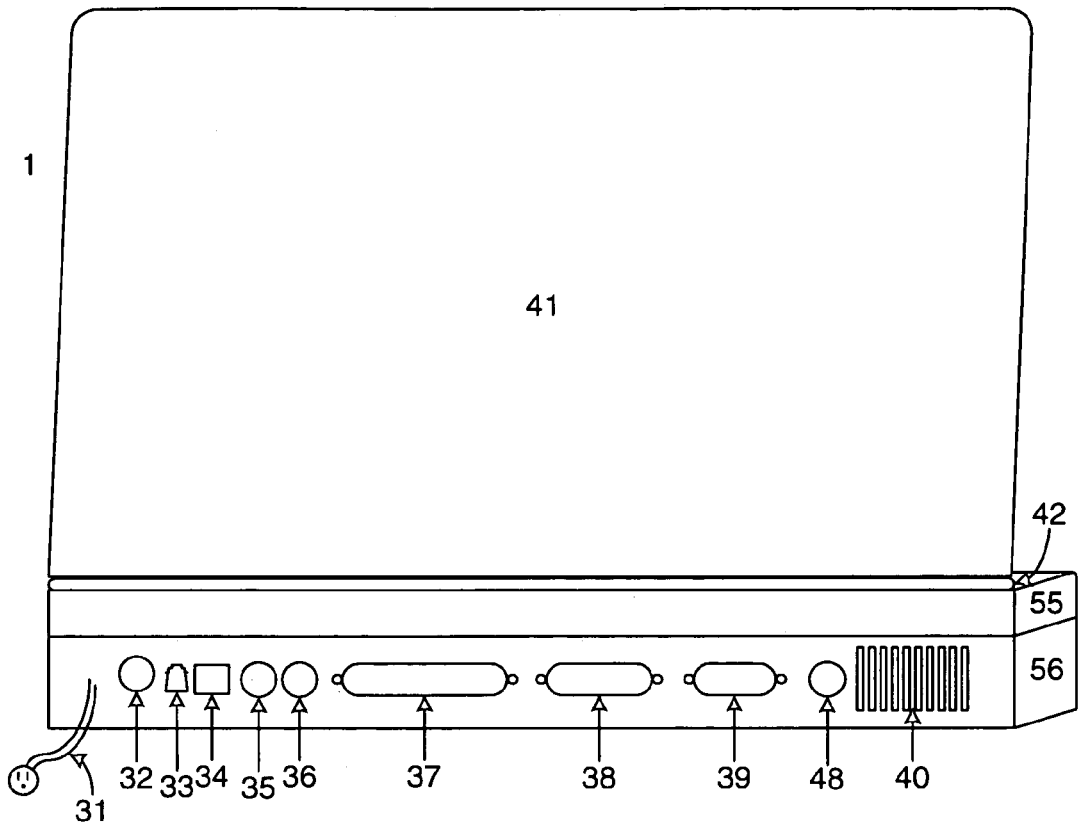
FIG. 2 illustrates a back view of one exemplary embodiment of the Integrated Information Presentation Device ("PowerPodium") according to this invention.
Figure 3:
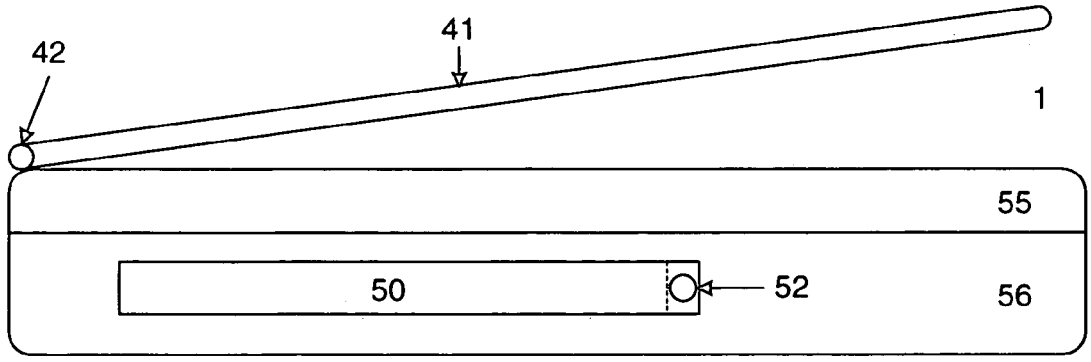
FIG. 3 illustrates a view of the left side of one exemplary embodiment of the Integrated Information Presentation Device ("PowerPodium") according to this invention.
Figure 4:
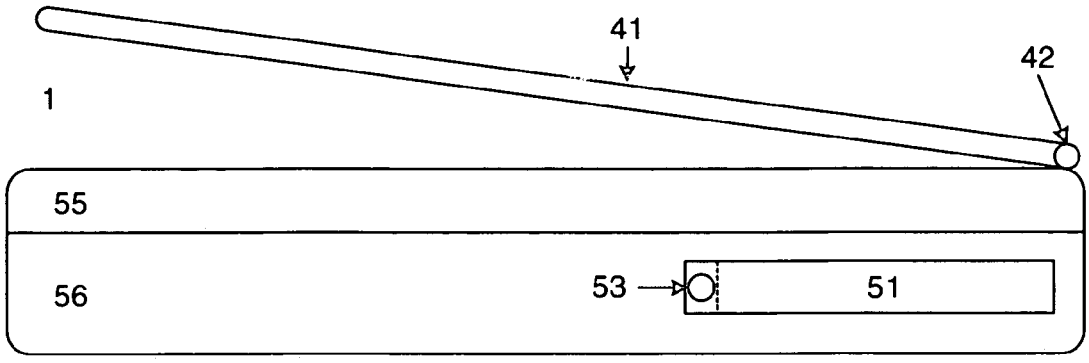
FIG. 4 shows a view of the right side of one exemplary embodiment of Integrated Information Presentation Device ("PowerPodium") according to this invention.
Figure 5:
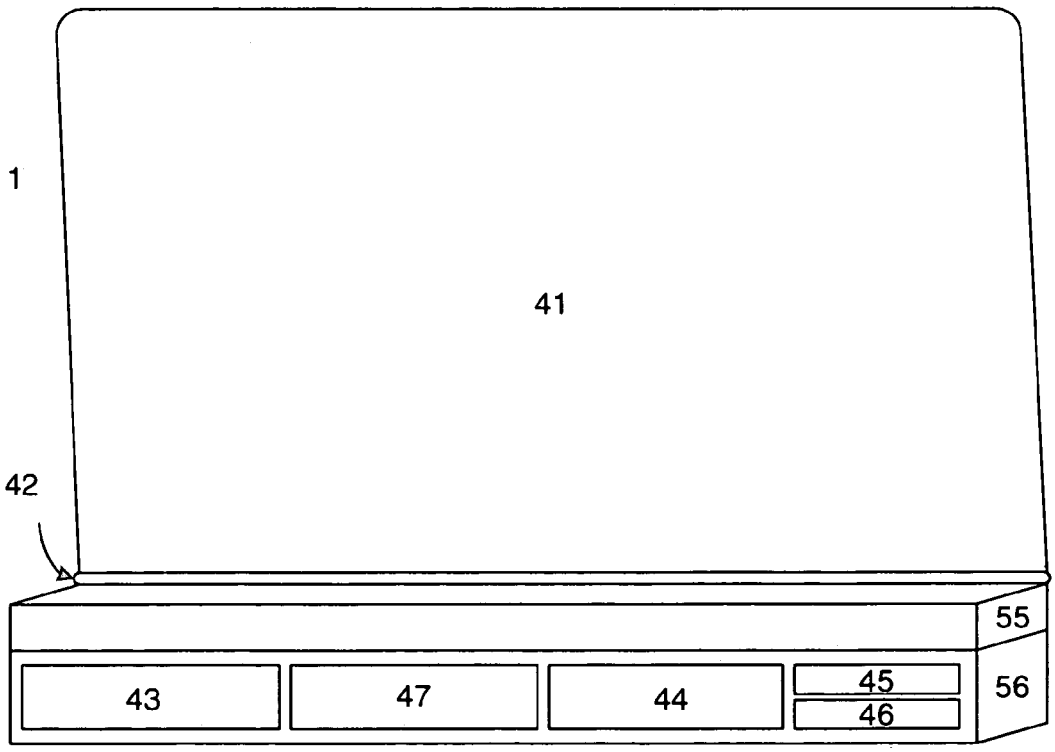
FIG. 5 shows a view of the front side of one exemplary embodiment of the Integrated Information Presentation Device ("PowerPodium") according to this invention.

An exemplary embodiment of the Integrated Information Presentation System With Environmental Controls aims, for example, to alleviate many of the problems associated with making presentations of all types, and making them easier to give and of a higher quality to receive. The Integrated Information Presentation System With Environmental Controls comprises a combination of an Integrated Information Presentation Device (also known as a PowerPodium), an Integrated Presentation Environment Assembly with Controls (also known as a Presentation Booth), a Personal Handheld Computing Device Presentation System to Interact with Various Projection Devices, a stylus, and a remote control. With the Integrated Information Presentation System With Environmental Controls, aspects of a presentation are enhanced, as well as providing the speaker an opportunity to enhance his skill in giving a presentation.

The Integrated Information Presentation Device 1 is generally related to the field of Presentation Devices, and to the field of Computing Devices (commonly called computers). Methods are introduced to control environmental variables, interact with staff and audience, and enhance the ability of speakers to present high quality presentations.

For many years, people who make public or private presentations have contended with multiple devices to control lights, sound, time of presentation, and the slide presentation itself. With the Integrated Information Presentation Device the speaker now will be able to, for example, control, electronically, these—and many other—features, integrated in one manageable package.

The Integrated Information Presentation Device and its associated features are comprised primarily of a casing with a display, hardware controls embedded in it or software controls, various input and output devices, and a processing unit. The Integrated Information Presentation Device is to be located, for example, in or on meeting room podiums or other appropriate platforms to increase the effectiveness of presentations. The base, the PowerPodium Central Unit 56, of the Integrated Information Presentation Device may also be housed out of sight to allow a less cluttered working area for the speaker. The features of the Integrated Information Presentation Device may be implemented by various combinations of both hardware and software and any combination thereof. The display is visible to the speaker, but may not be to his or her audience. The screen and its features enable the speaker to focus on the speech and audience at hand and eliminate distractions.

With the Integrated Information Presentation Device, these environmental functions may be controlled by the fingertips of the speaker at a time he or she determines appropriate. There are also devices used to interact with facility management in case that immediate help is needed. Software programs, commonly called "Instant Messaging" or E-mail, currently enable two people to send information back and forth. Programs similar to one or both of these can be used to relay information from the audience to the speaker, or more likely, from an assistant to the speaker. There are also similar programs found in cellular telephones and in some text pagers, which may also be utilized as audience interface devices.

In a first exemplary embodiment, encompassing FIGS. 1 through 5, the Integrated Information Presentation Device with many features installed is described. In particular, the Integrated Information Presentation Device 1 comprises a display 2, divided into a presentation screen 2A and a Message Center 2B, a time of day clock 3A, a time keeper 3B, an Internet button 4A, a presentation button 4B, a previous slide button 5A, a next slide button 5B, lighting controls 6, window lighting controls 7, presentation screen controls 8, sound controls 9, microphone controls 10, temperature controls 11, air flow controls 12, shortcut mode buttons 13, black screen button 14, white screen button 15, mute button 16, slide sorter view button 17, left trackball button 18A, right trackball button 18B, trackball 18C, Assistance Required Button 19, keyboard 20, power cord 31, video out 32, modem 33, Ethernet port 34, mouse port 35, keyboard port 36, parallel port 37, serial port 38, video interface port 39, cooling vent 40, protective cover 41, protective cover hinge 42, DVD-ROM drive 43, 250 MB Zip™ drive 44, 3.5" floppy disk drive 45, media card reader 46, CD-ROM drive 47, infrared port 48, remote control storage compartment 50, stylus storage compartment 51, remote control locator button 52, stylus locator button 53, detachable presenter unit 55, and PowerPodium central unit 56. It is to be appreciated that any peripherals, devices, components, or parts that can be utilized with computing devices may be incorporated with the Integrated Information Presentation Device. Additionally, the term module as used herein can be any hardware, software, or combination thereof, that can be used to perform the functionality associated therewith.

The display 2, for example, may be any photon-emitting or photon-reflecting device which can be configured to display words or images from a CPU or other computing device. Some embodiments of the display are the cathode-ray tube, the liquid crystal display (LCD), and the plasma display.

A exemplary embodiment of the Integrated Information Presentation Device will enable the speaker the option to separate the Detachable Presenter Unit 55 from the PowerPodium Central Unit 56. These two units may be kept physically together, or they may be separated to allow an uncluttered presentation area. The Detachable Presenter Unit 55 could contain all hardware integral to control the presentation and the environment as it is given, and optionally a protective cover 41 fastened by a hinge 42. The PowerPodium Central Unit 56 can have the hardware essential to the processing of presentation software, message center, and other commands, as well as the removable storage interface devices. The connection between the units may be a physical connection (such as, but not limited to, electrical wire, fiber optic cable, or other physical connection energy transmission device), or may be a wireless connection (such as, but not limited to, Infrared, Ultrasound, Radio Wave, or other device capable of transmitting and receiving energy). The PowerPodium Central Unit 56 may have a power cord 31 to be connected to a power source, it may have a self-contained power source, such as, but not limited to a battery, or it may have a connection to the Detachable Presenter Unit 55 and draw power from it. The Detachable Presenter Unit 55 may have a power cord to be connected to a power source, may have a self-contained power source, such as, but not limited to a battery, or may have a connection to the PowerPodium Central Unit 56 and draw power from it. The PowerPodium Central Unit 56 may also have a cooling vent 40 to assist in dissipating heat from the unit.

When using the exemplary Integrated Information Presentation Device, the speaker may prepare a presentation at some external location of his choice, and transfer that presentation to the invention by such means as, but not limited to, a CD-ROM diskette, a floppy (or 3.5" disk), an Iomega Zip™ disk (or Jaz™ disk), DVD, a flash memory unit, via e-mail, FTP, WI-FL, wirelessly, or the like. One exemplary embodiment of a removable storage reader and writer that provides access for many different storage technologies, for example, is known as the AtechFlash Pro II Media Card Reader which has the capability of reading the following technologies: Compact Flash™, IBM Microdrive™, SmartMedia™, Multimedia™, and Secure Digital™ plus. It also has a front USB port to connect to various other technologies. Of course, as technologies change and advance, new removable storage devices will become available and are easily incorporated into the design of the Integrated Information Presentation Device as warranted. These storage drives may be physically located on any surface of the Integrated Information Presentation Device, and may have retractable or removable covers to prevent damage.

One exemplary feature of the Integrated Information Presentation Device involves the installation of "Agenda File Organizer" software. This software can be activated (or can be auto-activated) to run whenever the speaker inserts a removable medium. The exemplary purpose of this software would be to copy the presentation file (and any other appropriate files) to, for example an internal hard drive or memory for later use, thereby enabling the speaker to "save" his presentation on the particular instance of the Integrated Information Presentation Device he will use, and to keep the removable media elsewhere as a "backup." This feature would make it possible for a conference organizer to arrange the presentation files in the order they appear on a conference program, and for the presentation files to be opened in an orderly sequence. While some computer users may not need such software, it may be desirable to have this available as an option for those speakers who are not as comfortable manually controlling this process.

Another feature of the Integrated Information Presentation Device is to enable a speaker to make use of what is called "Multiple Monitor" support ("Dual Display," "Dual-view," etc.) available in some presentation packages. By using this feature, the speaker can view his slides in a format tailored for speakers, including any notes the speaker developed, as well as smaller views of some combination of the current, previous and next slide. The audience will see a second view comprising normally of only the current presentation slide. This second view is actually the view of the "second monitor," although it may be fed to a projector or a screen suitable for audience viewing (like large plasma screens, for instance). This may be accomplished by such means as, but not limited to, using two video cards or a single dual display video card, for example. One of the output signals is fed to a projector to display the presentation to the audience.

The presentation portion of the Integrated Information Presentation Device, visible normally only to the speaker, commonly referred to as a screen 2, may display the graphic and textual outputs of one or multiple software programs running on the Integrated Information Presentation Device to enable the speaker to customize the presentation. The software programs include, but are not limited to presentation software, and messaging software. Shortcut buttons (either physical or software implemented) may be provided, for example, to quickly format the screen into any one of a number of desirable configurations. Such formats could be optimized for showing the speaker's notes at maximum size, showing just the slide and the message center, or segmenting the screen to show all available image sources and files. The shortcut buttons interact with the appropriate software and hardware, for example, to segment the presenter's screen, the audience's screen, or both to enable the presenter to make the best use of available tools without cluttering up the view with unnecessary ones. For instance, it may be desirable for the speaker to see the presentation slide, the message center, a live video feed of himself, and a live video feed of a remote speaker or audience who may be participating in the same program. At the same time, he may not want to clutter the audience view with all of those windows, so the audience screen image may be formatted to have only the main slide view and one or more speaker's live image feed. It is envisioned that many possible configurations utilizing many different layouts of both the speaker's screen and the audience's screen are highly desirable, so providing a customizable view for both is a highly desirable feature. Remotely located speakers will be able, for example, through the Integrated Information Presentation Device and peripherals such as, but not limited to, a video camera, to provide audiences with a virtual presentation that can be nearly identical to the experience of those physically present with the speaker. It is also possible to enhance the experience of the audience beyond the remote environment of the speaker. For example, a speaker may be presenting through an instance of an Integrated Presentation Environment Assembly with Controls, configured to transmit the presentation to a remote audience in a large lecture hall twenty feet, one mile, or thousands of miles away, without requiring the presenter to be in a large lecture hall himself or herslef. In some cases, such as a sudden absence of a speaker due to illness, a replacement speaker may be enlisted to give a presentation on extremely short notice. The Integrated Information Presentation Device would enable such a speaker to remotely control the presentation as long as some type of connection (Internet, intranet, pots, satellite, etc.) is present to enable commands to be sent. It may be desirable to transfer the presentation files to the speaker's instance of the Integrated Information Presentation Device prior to the presentation time. In the event that such a transfer is impossible or impractical, the presentation may be stored on the instance of the Integrated Information Presentation Device physically present with the audience. In this case, the speaker's view of the slides, notes, and other programs must be transmitted to the speaker's instance of the Integrated Information Presentation Device, and commands sent from the speaker to the instance of the Integrated Information Presentation Device physically present with the audience. Of course, during these times audio devices and other devices used in the presentation can also have their information transmitted.

The presentation software will most likely be a widely used package (although this is not required and custom software may be used) to allow speakers the ease of preparing their own presentations at some previous point.

During the presentation, the speaker controls the advancement of presentation slides using the "Previous Slide Button" 5A and the "Next Slide Button" 5B. These buttons will trigger the appropriate software response to bring either the next or previous slide into view on both the speaker's screen and the audience's screen(s).

The message center 2B may be used to enable an assistant to relay information to the speaker which will help him or her adjust the presentation as it is given to enable customization of the information. Some possible examples of uses of this feature include, but are not limited to, addressing situations as they arise (such as a message that someone's car lights are on), or to remind the speaker not to forget to emphasize a particular point, or to make the speaker aware of any mistakes presented to enable immediate correction. Another use of the message center may be to enable audience members to submit questions to the assistant (before, during, or after the presentation) using electronic means such as, but not limited to e-mail, or other means, such as, but not limited to submitting a hand-written note. The assistant may then filter these questions as appropriate and send them to the speaker using the message center. The message center may be embodied with software such as, but not limited to, "Instant Messenger" technology over the Internet or an intranet, electronic mail protocols, or file transferring from one computer to another.

An exemplary embodiment of the Integrated Information Presentation Device may be embodied with the following feedback devices to enable the speaker to quickly view their status.

Time of Day Clock 3A—A Time of Day Clock comprises analog and/or digital clocks that display the current time of day. The Time of Day Clock may or may not be integrated with other devices on the Integrated Information Presentation Device.

Time Keeper 3B—A Time Keeper comprises a timing device which can be set to the time allotted to the speaker to present his material. In the Time Keeper, both an elapsed time and remaining time may be displayed, as well as a visual representation of the percentage of time elapsed, as in a "shrinking bar" format. The Time Keeper may or may not be integrated with other devices on the Integrated Information Presentation Device.

An exemplary embodiment of this invention may include, but is not limited to, different combinations of the following features. The following descriptions refer to FIG. 1 showing one possible embodiment of the device. These controls will involve either the use of wireless communications to send control signals to external devices or the devices may be hardwired.

Lighting Controls 6—Lighting Controls comprise controls enabling the speaker to customize the lighting of the presentation. The lighting controls may include, but are not limited to, controls to adjust the brightness of lights on the speaker, and controls to adjust the brightness of lights on the audience.

Window Lighting Controls 7—Window Lighting Controls may house controls for enabling the speaker to control the amount of light entering the presentation room from external sources (for example, the sun). The Window Lighting Controls may include, but are not limited to, a device which triggers a mechanical operation of individual blinds, shades, and/or curtains, a device to control the opacity of liquid crystal glass, or other means to control the blocking of light, either partially or totally. For example, liquid crystal glass is glass that is made with a thin film of liquid crystals such as those commonly found in digital watches so that when an electric current is turned off and on, a corresponding change will take place in the liquid crystals so as to block light (or diffuse it) or allow light to pass through the window. This glass can be used in windows as an alternative to having physical window shades, blinds, or curtains.

Presentation Screen Controls 8—Presentation Screen Controls comprise controls for raising and lowering one or more projection screens. Also, in general, controls can also govern other types of automated hardware that perform various functions.

Sound Controls 9—Sound Controls comprise controls for adjusting the balance and volume of the room sound system to produce the desired effect for the presentation listeners.

Microphone Controls 10—Microphone Controls comprise controls for the purpose of enabling the speaker to adjust the input from various microphones throughout the presentation area. The microphone controls may comprise, but are not limited to, a master control to adjust all microphones at once (such as to turn them all off) and individual microphone controls to enable the speaker to control participation from various points in the presentation area.

Temperature Controls 11—Temperature Controls comprise controls to enable the speaker to adjust the desired temperature for the presentation or audience area.

Air Flow Controls 12—Air Flow Controls comprise controls to enable the speaker to turn on devices to increase air circulation, such as, but not limited to, circular fans. The Air Flow Controls may optionally allow for the selection of settings such as high speed, medium speed, low speed, and off.

Pointer control device 18—A Pointer Control device comprises a control to maneuver the "pointer" on the screen used to select various items. One common embodiment of the pointer control device is known as a "trackball." A "trackball" would normally comprise a "left trackball button" 18A, a "right trackball button" 18B and a "tracking ball" 18C. Other common embodiments of the pointer control device include, but are not limited to a "mouse," a touchpad, a trackpad, a joystick, and head-movement tracking devices.

Black Screen Button 14—A Black Screen Button comprises a control to provide a way for the speaker to easily and quickly black out the screen viewed by the audience, so as to provide a way to find a desired slide or fix an error without allowing the audience to view or be distracted by this process. The black screen button may optionally also activate a feature known as "slide-sorter" view to enable the speaker to quickly find a desired slide.

White Screen Button 15—A White Screen Button comprises a control to provide a way for the speaker to easily and quickly white out the screen viewed by the audience, so as to provide a way to find a desired slide or fix an error without allowing the audience to view or be distracted by this process. The white screen button may optionally also activate a feature known as "slide-sorter" view to enable the speaker to quickly find a desired slide.

Mute Button 16—A Mute Button comprises a control to turn off all sound output from the current configuration of the Integrated Information Presentation System With Environmental Controls.

Slide Sorter View Button 17—A Slide Sorter View Button comprises a control to provide a shortcut to enable the speaker quickly to get to the view that displays a thumbnail view of all slides and enables the speaker to access a specific slide by selecting it. The Slide Sorter View Button will also be set to black out (or white out) the audience screen while this process is going on to minimize distractions to the audience.

Internet Button 4A—An Internet Button comprises a control to enable the speaker to quickly switch software programs to allow browsing of the Internet. The use of the Internet Button requires a connection to the Internet to be established, either prior to the presentation, or immediately upon request or, lacking this connection, that the desired web pages have been cached or downloaded into volatile or non-volatile memory, available for browsing 'off-line.' Optionally, this button may automatically establish the Internet connection as part of its function.

Presentation Button 4B—A Presentation Button comprises a control to enable the speaker to quickly switch software programs to the presentation software.

Shortcut Mode Buttons 13—Shortcut Mode Buttons comprise a control to enable saved settings to be used to reset the environment to a previously determined configuration. This previously determined configuration could be a static configuration or a programmable configuration. The shortcut mode buttons configure multiple settings of environmental devices in response to being activated, so that a speaker does not need to adjust each device separately. One of the shortcut buttons, for example, may be set up for providing a general presentation environment. The speaker can then use the various other environmental control buttons to "fine tune" the environment to his or her liking. For another example, one of the shortcut buttons may be set up to turn on all lights to enable the audience to more easily enter and exit the room during intermissions.

Assistance Required Button 19—also known as the "panic button" or "HELP button" an Assistance Required Button comprises a control to enable the speaker to alert facility staff when immediate assistance is needed for security or technical assistance. The Assistance Required Button is protected from accidental activation, for example, with a cover and raised lip surrounding it. The Assistance Required Button would trigger a response by the Integrated Information Presentation Device to notify the appropriate people that immediate assistance is needed in the conference room. The Assistance Required Button may be alternatively configured as a toggle switch, such that the signal is continuously sent until the speaker deactivates it, presumably when help has arrived.

The Integrated Information Presentation Device may also include, but is not limited to, the following interface devices.

Video Out 32—a Video Out port comprises a port used to send the video signal of the audience presentation image to an external video image display unit, for example, a projector. The image defined by this signal may be identical to the image the speaker sees on the main display, or more likely, it will be an image of only the presentation elements to be viewed by the audience as transmitted by the presentation software.

Modem 33—a Modem interface comprises a port used to connect the invention to an external computing device, most likely a computing device used as an entry node or gateway to the Internet, using a plain-old telephone system line (POTS line). The modem may also be used to link to the Internet using a higher speed line such as, but not limited to, a Digital Subscriber Line (DSL), a Cable Modem line, or an Integrated Services Digital Network line (ISDN), for example (additional hardware may be necessary in some cases; not all services are available in all areas).

Internal Telephone Instrument—an Internal Telephone Instrument comprises a device which can be set up to enable the speaker to communicate by telephone before, during, or after the presentation from the presentation site, specifically, from the Integrated Information Presentation Device. The Internal Telephone Instrument may be connected through a wireless connection, or through a physical wire. As there are programs to enable a computer to use the modem line for this purpose, there may not be a need to have both a modem line and a phone line, although it may be useful to some speakers if they want to be connected by phone to someone off site, while they are browsing on the Internet. Alternatively, a "private line" may be set up which connects internally to the audio visual department, either directly or by use of an extension. The telephone instrument may be able to operate as a speakerphone. Alternatively, an external jack may be installed in the Integrated Information Presentation Device to enable a speaker to connect his own phone to the line, whether to allow some privacy on the call or to enable communication even if the speakerphone is not in perfect working order.

Ethernet Port 34—an Ethernet port comprises a port used to connect the invention to a local area network (LAN) within the building/company, and thus access to a server, the company intranet, or the Internet. Frequently, there is a server computer and/or a firewall before the LAN connects to the Internet (or WAN—wide area network). The connector for the Ethernet port looks very similar to the connector on a phone line, but is slightly larger.

Mouse—a mouse is one common embodiment of a pointing device which enables the user to control a pointer on the screen and initiate various actions using the buttons on the mouse (commonly two). The mouse is commonly connected using a PS/2 port (also known as a "Mouse port") 35, a serial port, or a USB port. The mouse can be, for example, mechanical (a type of mouse with a hard, rubber-coated ball which moves mechanical sensors as one moves the mouse over a surface), opto-mechanical (Same as mechanical, but uses optical sensors to detect the motion of the ball), or optical (no moving parts, but uses a light-emitting diode or similar electronic part and a sensor to detect motion over a surface) and they can be cordless or connect with a cord.

Keyboard 20—a keyboard is a common embodiment of an alphanumeric input device which enables the user to send commands or strings of characters represented by a combination of digital bits (called bytes), which cause the current software to respond with some function, or to record the intended character, most commonly using ASCII codes (but may also be Unicode or EBCDIC (no longer widely used)). The keyboard may be desired to interface with the operating system or application software during set-up and may be detached during the presentation, although this may not be required. A storage container, for instance a drawer, may be housed in either the invention body, or in the podium, to enable the keyboard to be out of view and out of the way during the presentation. The keyboard may be wireless (using an internal or external wireless keyboard port), or it may have a physical connection (a keyboard port 36).

In addition to the ports to interface to the above devices, this invention may also include, but is not limited to, any combination of the following interface ports. These ports can be used to connect to a specialized device or new devices as they become available on the marketplace.

Parallel Port 37—A parallel port is a type of interface port that transmits digital data over eight pins in groups of eight bits (one bit on each pin) simultaneously. There are other pins used in the parallel port to send information about the data, and to enable communication between the device and the peripheral. A common peripheral that uses the parallel port is a printer.

Serial Port 38—A serial port is a type of interface port that transmits digital data one bit at a time over one pin. Other pins are used to send information about the data and to enable communication between the device and the peripheral. Serial ports are slower than Parallel ports, and may be phased out by USB ports.

Video Interface Port 39—A video interface port is an interface port for video displays, monitors, and graphical output devices. In an exemplary embodiment of the Integrated Information Presentation Device, the video interface port is connected to either a second video card, or to a video card with two output ports. In another embodiment of the Integrated Information Presentation Device, the port may be simulated by a signal splitting or signal duplicating device. In this latter instance, however, some of the robust features associated with the presenter's view as opposed to the audience's view would not be possible, since splitting or duplicating the signal produces identical images for both the presenter and audience. The video interface port transmits a second video signal to an external monitor, for example, a projector.

Infrared Port 48—An infrared port comprises a device which can detect and decode signals in the infrared range of the electromagnetic spectrum, and optionally transmit electromagnetic signals in the infrared range. The infrared port may be used to receive signals from a device such as, but not limited to, a remote equipped with an infrared transmitter, or the infrared port may be used to send output to a device such as, but not limited to, a printer. In some embodiments it is advantageous to have multiple the infrared ports, depending on the actual design and purpose of the embodiment of the invention. Some of the infrared ports may be used to send instructions to various external devices which control environmental variables.

RF Transceiver Port—An RF transceiver port (sometimes known as just an RF Transceiver) comprises a device which can transmit to and receive signals from various devices that control the environment. It may be appropriate to have multiple RF Transceiver ports, depending on the actual design of the embodiment of the Integrated Information Presentation Device.

An exemplary embodiment of the Integrated Information Presentation Device may include, but is not limited to, any, a combination of, or all of the following removable storage devices.

Read/Writeable DVD Drive 43—A Read/Writeable DVD (Digital Video Disc) Drive is a device which is used to read digital signals from or write digital signals to a disc properly formatted for such uses.

Zip™ Drive 44—a Zip™ Drive is a device that provides a large amount of digital data storage on a diskette that is not much bigger than a standard 3.5" Floppy disk. The 250 MB Iomega Zip™ Drive is compatible with older 100 MB Zip™ Drive Cartridges. Iomega also manufactures a larger Jaz™ drive, whose disks hold either 1 GB (older) or 2 GB of data.

3.5" Floppy Disk Drive 45—a device used to read magnetic diskettes capable of up to 1.44 Megabytes of digital data storage Media Card Reader 46—a device that reads multiple formats of removable storage. One such instance of the Media Card Reader fits into a 3.5" floppy disk drive bay and reads/writes the following types of media cards: Compact Flash™, IBM Microdrive™, SmartMedia™, Multimedia™, and Secure Digital™ plus. The instance of the media card reader also has a front USB Port to enable the connection of various other removable storage devices. If another instance of a media card reader is used that is not equipped with a USB Port, a separate USB port should be added to the device.

Read/Writeable CD-ROM Drive 47—"Compact Disc" Read Only Memory. A Read/Writeable CD-ROM (Compact Disk Read Only Memory) Drive is a device which is used to read digital signals from or write digital signals to a disk properly formatted for such uses.

Figure 6:
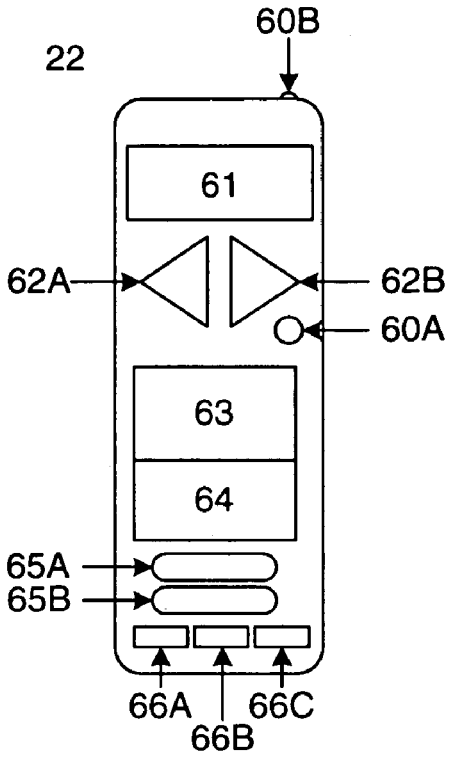
FIG. 6 shows a top view of one exemplary embodiment of the remote control according to this invention.

The Integrated Information Presentation Device may also include, but is not limited to, any or all of the following external components and their storage compartments Remote Control 22—The Integrated Information Presentation Device may also have a remote control, which enables the speaker to move freely from the Integrated Information Presentation Device throughout the room. An exemplary remote control 22 is shown in FIG. 6 comprising a pointer activation button 60A, pointer lens 60B, lighting controls 61, previous slide button 62A, next slide button 62B, sound controls 63, microphone controls 64, Internet button 65A, presentation screen button 65B, time of day display 66A, presentation time elapsed 66B, and presentation time remaining 66C.

A pointing device similar to what is commonly known as a "laser pointer" may be incorporated into the remote control so that as the speaker moves about the room, he or she can point to various parts of the image using the remote. The remote control will most likely be battery operated, although this is not a necessity (with the understanding that wires may hinder the mobility of the speaker). The commands from the remote control may be processed through the Integrated Information Presentation Device, and then distributed to any appropriate external devices through a single set of transmitters. Alternatively, the commands may be sent directly from the remote control to the appropriate external devices, the alternate remote actually comprising a conglomeration of remotes.

The remote control may be housed in the Remote Control Storage Compartment 50 when not in use. The Integrated Information Presentation Device may give the user a warning message and/or sound a warning bell if the Integrated Information Presentation Device is shut down without the remote control being in the Remote Control Storage Compartment. This will aid in preventing the accidental misplacement of the remote control between speakers, especially if the assistants breaking down the room are not aware of all the features/components of the Integrated Information Presentation Device. Likewise, a Stylus Storage Compartment 51 optionally ensures that the stylus 53 is kept with the unit. The Remote Control Storage Compartment and Stylus Storage Compartment may also comprise, but are not limited to, components to enable the recharging of batteries in the remote control or the stylus while it is being stored, a locking mechanism to hold the remote control or the stylus firmly in place, and a protective cover. Next to each storage compartment, optionally, a button to "locate" the remote control 52 or to locate the stylus 53, which may be pressed if it is misplaced. This button may trigger a process to sound an audible and/or show a visual alert to enable the missing remote control 52 or the missing stylus 53 to be tracked down, similar to devices found in some portable telephone handsets and television remotes. The alert may sound/flash for a specified time, or it may continue until a button is pressed on the remote control or the stylus once it has been found.

Figure 8:
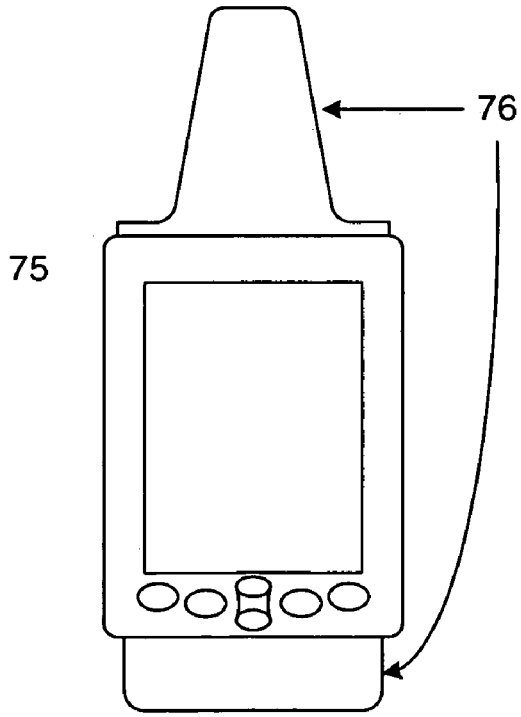
FIG. 8 shows a top view of one exemplary arrangement of the Information. Display Device System ("PDA-device") on a pocket computer according to this invention.

As an alternative (or as an addition) to the remote control, another solution is to enable people to use their own handheld computing devices, also called personal digital assistants (PDAs—Pocket PCs, Palm Pilots, etc.) 75, to control their presentations. See FIG. 8. Currently, there is no standard for the port to attach accessories to differing types of handheld computing devices, so to enable multiple versions of handheld computing devices to be used, multiple transmitters with the appropriate connectors must be included with the Integrated Information Presentation Device (Unless the Integrated Information Presentation Device is tied to a specific type of handheld computing device). Software can be distributed to speakers which would enable them to use their own handheld computing devices to control the functions of the Integrated Information Presentation Device. A transmitter 76 can be provided to the speaker by the conference center that would enable the output of the software program running on the handheld computing device (commands to carry out) to be transmitted to the Integrated Information Presentation Device. The transmitter may be particular to one particular instance of the Integrated Information Presentation Device (or may be reprogrammed each time if possible), used by the speaker only during his or her setup, rehearsal, and presentation. One major advantage of this would be that speakers could use their own handheld computing devices and software to control the presentations in any conference center that has an Integrated Information Presentation Device. The software on the handheld computer may control only basic functions, or it may duplicate every function of the Integrated Information Presentation Device. Although presentation screen data can be transmitted to the Integrated Information Presentation Device, it is more likely that the presentation would be pre-loaded on the Integrated Information Presentation Device and the handheld computer—only the commands need to be transmitted from the handheld computer to the Integrated Information Presentation Device. A stylus 24 is optionally provided that could be used in conjunction with handheld computing devices that would function both as an input to the touch screen of the handheld computing device, as well as a laser pointer device for calling attention to images on the audience screen. For example, the stylus may be equipped with the input device at one of its ends, and the laser pointer at the other.

Additionally, if transmitters were distributed to members of the audience to use on their own handheld devices, or if handheld devices were available at the beginning of a session for audience use, this would enable the audience to interact with the speaker before, during, or after his presentation. Cell phones, two-way pagers, and other similar devices capable of transmitting text messages may also be utilized if the signal is routed to the Integrated Information Presentation Device using for example, e-mail over voice or data lines, text messaging, or other means.

Figure 7:
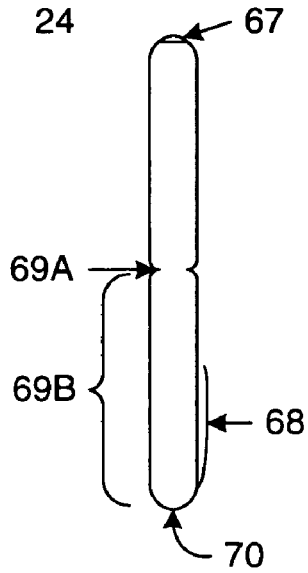
FIG. 7 shows a top view of one exemplary embodiment of the stylus according to this invention.

Stylus FIG. 7, #24—Optionally, a stylus enables the speaker to interact with the presentation screen, enabling notes to be "written" on the slides during the presentation. One possible embodiment of the stylus, a "dumb stylus," is used to provide only pressure or presence on a pressure sensitive or field feedback screen. Another possible embodiment of the stylus 24, a "smart stylus," "reads" the part of the presentation screen it is tracing through an electromagnetic sensing tip 67 and transmits this information back to the main device for processing. An imbedded laser pointer 70 may be embedded in the other end of either embodiment of the stylus 24 and activated by one of two optional activation features—the embedded laser pointer 70 being activated or deactivated by the rotating of one end 69B of the stylus 24 about the rotational switch 69A, or a switch activated by the pressing of the clothing clip 68 on the side of the stylus 24.

Figure 12:
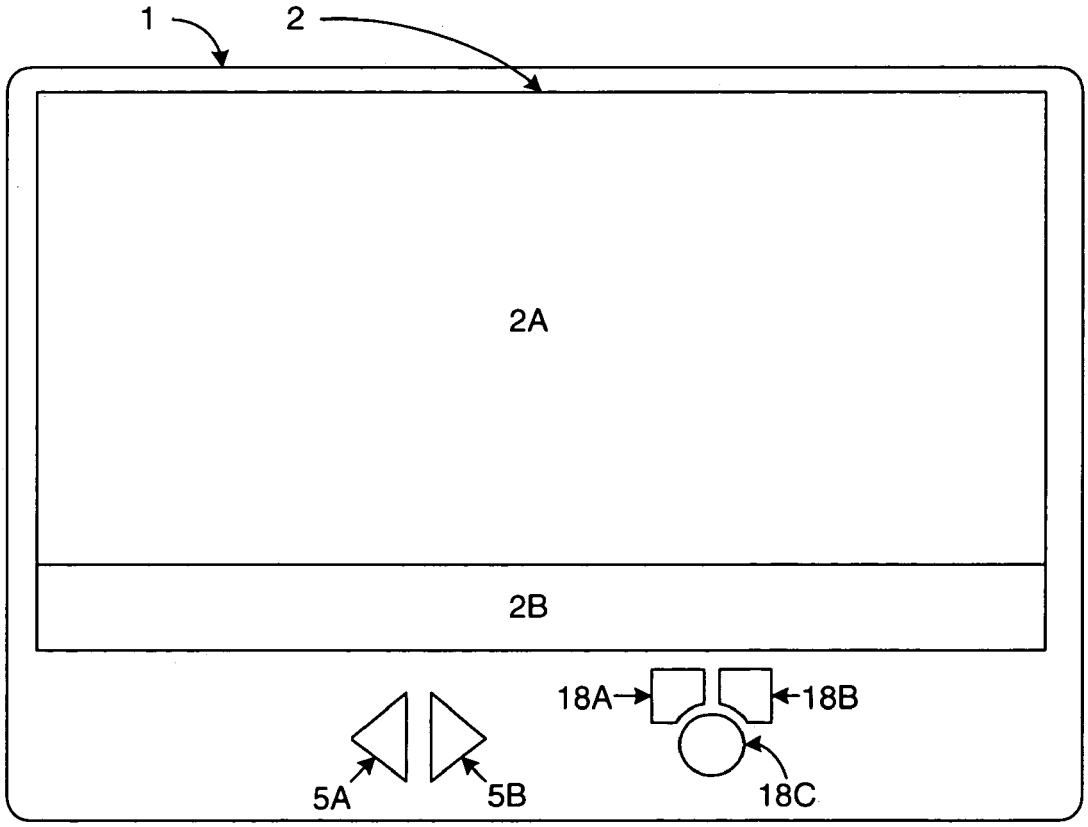
FIG. 12 shows an alternate exemplary embodiment of the viewable top of the Integrated Information Presentation Device ("PowerPodium") according to this invention.

A second exemplary embodiment, an extremely minimal view of available features, of the top view of the Integrated Information Presentation Device will now be described as shown in FIG. 12. In this exemplary embodiment, the viewable top surface of the Integrated Information Presentation Device comprises a viewable screen 2, slide navigation buttons 5A and 5B, and an embedded trackball 18A, 18B, and 18C. With this embodiment, the speaker would be able to load the presentation files, activate various programs using the trackball, and navigate the slides during the presentation using the previous slide button 5A and the next slide 5B. Alternatively, the trackball may be omitted and a mouse or other pointing device could be used to select programs. This embodiment would be ideal for situations where the environment is not controllable (i.e. outdoor presentations, private home sales presentations, etc), or where the frequency of presentations is such that a highly functional (and therefore presumably more expensive) device is not warranted (i.e. some classroom situations, independent contractor going to homes to secure bids, etc).

Figure 13:
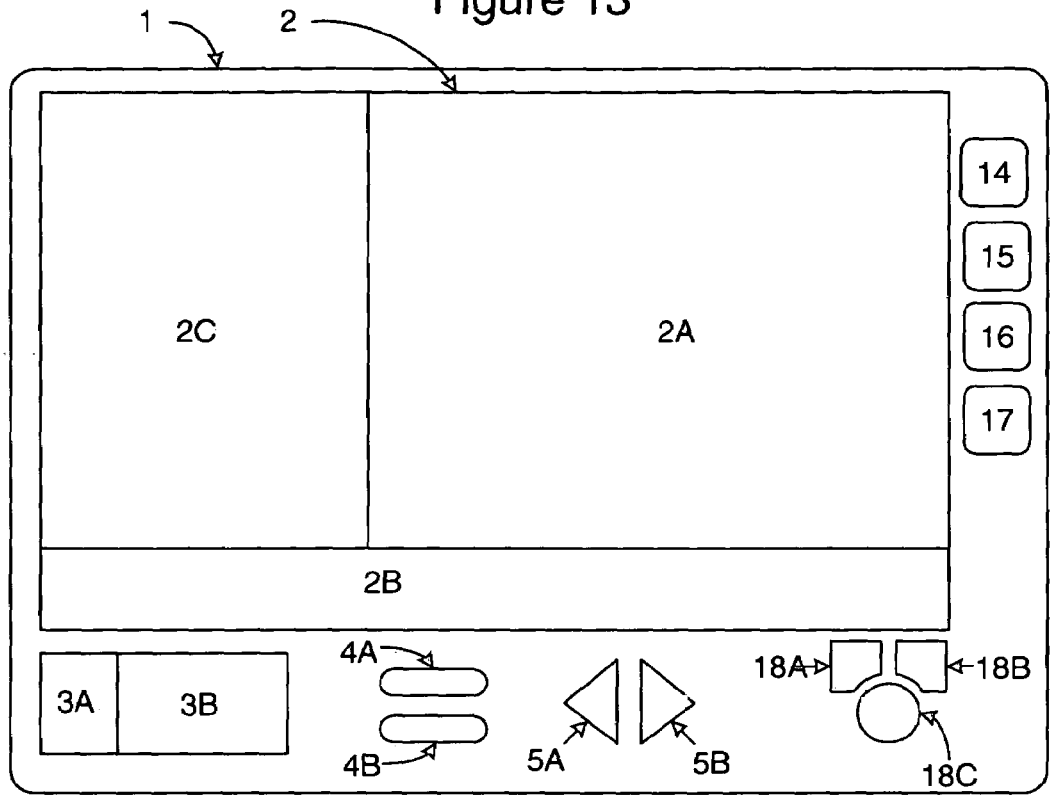
FIG. 13 shows an alternate exemplary embodiment of the viewable top of the Integrated Information Presentation Device ("PowerPodium") according to this invention.

A third exemplary embodiment, another possible configuration of the Integrated Information Presentation Device, will now be described as shown in FIG. 13. In this embodiment, the viewable top surface of the device comprises a viewable screen 2, time management instruments 3A and 3B, buttons to alternate between an Internet connection 4A and the presentation information 4B, slide navigation buttons 5A and 5B, an embedded trackball 18A, 18B, and 18C, Black Screen Button 14, White Screen Button 15, Mute Button 16, and a Slide Sorter View Mode Button 17. In this embodiment, the viewable screen 2 is divided between a live-feed image of the speaker 2C, the speaker's notes and slides 2A, and the message center 2B. The live-feed image of the speaker may be used in cases where the audience is so large that the speaker's image is also projected on a screen, or presented on a large viewable screen similar to those found in many professional sport stadiums, or where a "web-cast" or other broadcast of the presentation is being made. This configuration of the viewable screen 2 provides the speaker visual feedback as to his positioning, lighting, and movements during the presentations. This configuration may be utilized in cases where the presentation will be recorded and distributed at a later date.

Figure 14:
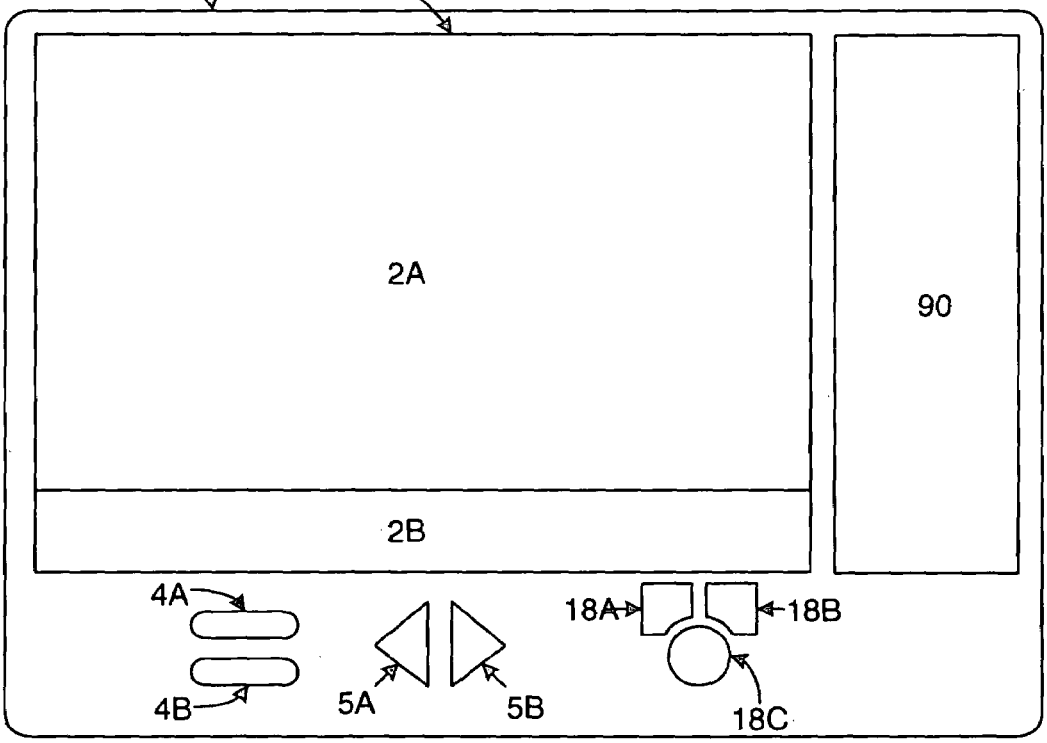
FIG. 14 shows an alternate exemplary embodiment of the viewable top of the Integrated Information Presentation Device ("PowerPodium") according to this invention.

A fourth exemplary embodiment, a possible minimal view from a professional speaker's point of view, of the Integrated Information Presentation Device will now be described as shown in FIG. 14. In this embodiment, the viewable top surface of the device comprises a viewable screen 2, buttons to alternate between an Internet connection 4A and the presentation information 4B, slide navigation buttons 5A and 5B, an embedded trackball 18A, 18B, and 18C, and some combination of environmental controls 90. The environmental controls are customized to be appropriate for whatever room(s) the device will be used in. This embodiment would enable a speaker to have some control over the environment (sound, lights, physical screen, etc), while not requiring that the hosting site give up all control of the environment to the speaker. Alternatively, certain functional controls can be installed but not enabled at any one time. A physical switch, or a software disablement of the control, may prevent a speaker from changing any one or group of environmental controls when the hosting site determines that speaker control over an environmental variable is not desired (for example, allowing the heater to be activated during summer months, allowing any equipment to be activated while undergoing repairs).

Figure 15:
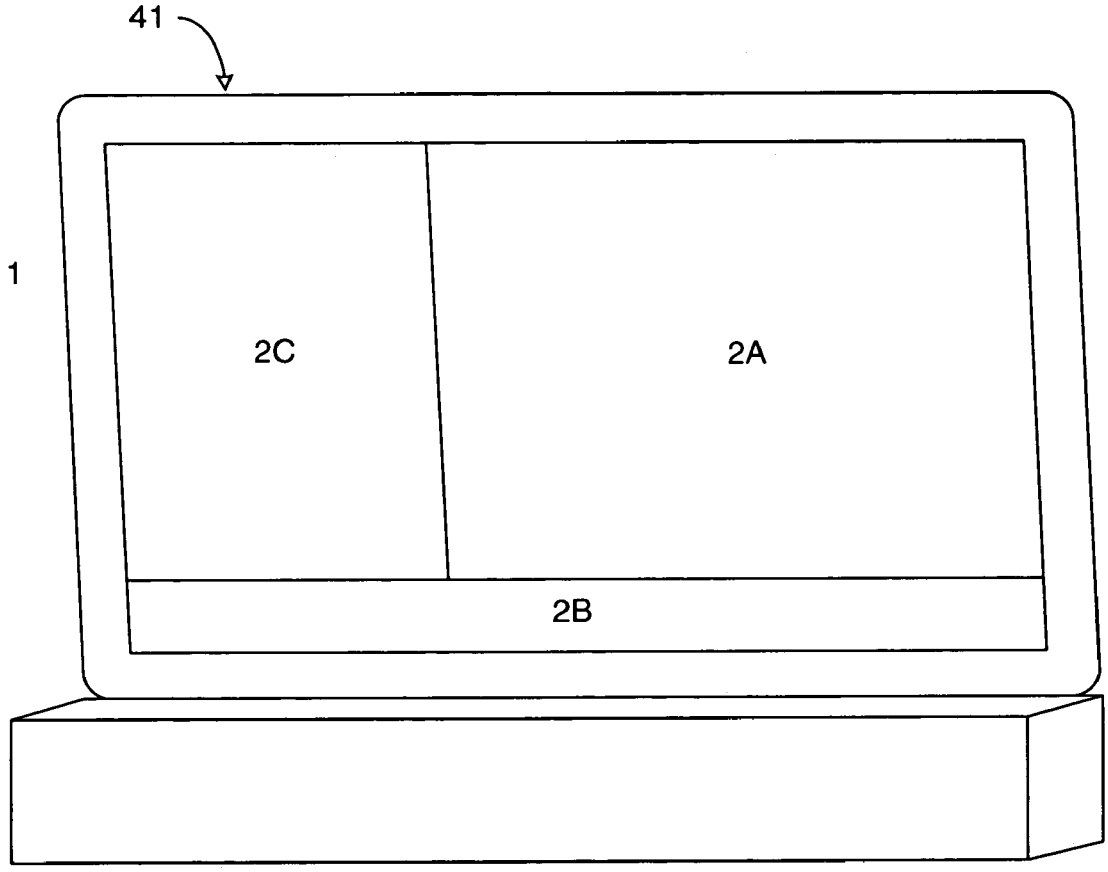
FIG. 15 shows an alternative exemplary embodiment of the cover of the Integrated Information Presentation Device ("PowerPodium") according to this invention.
Figure 16:
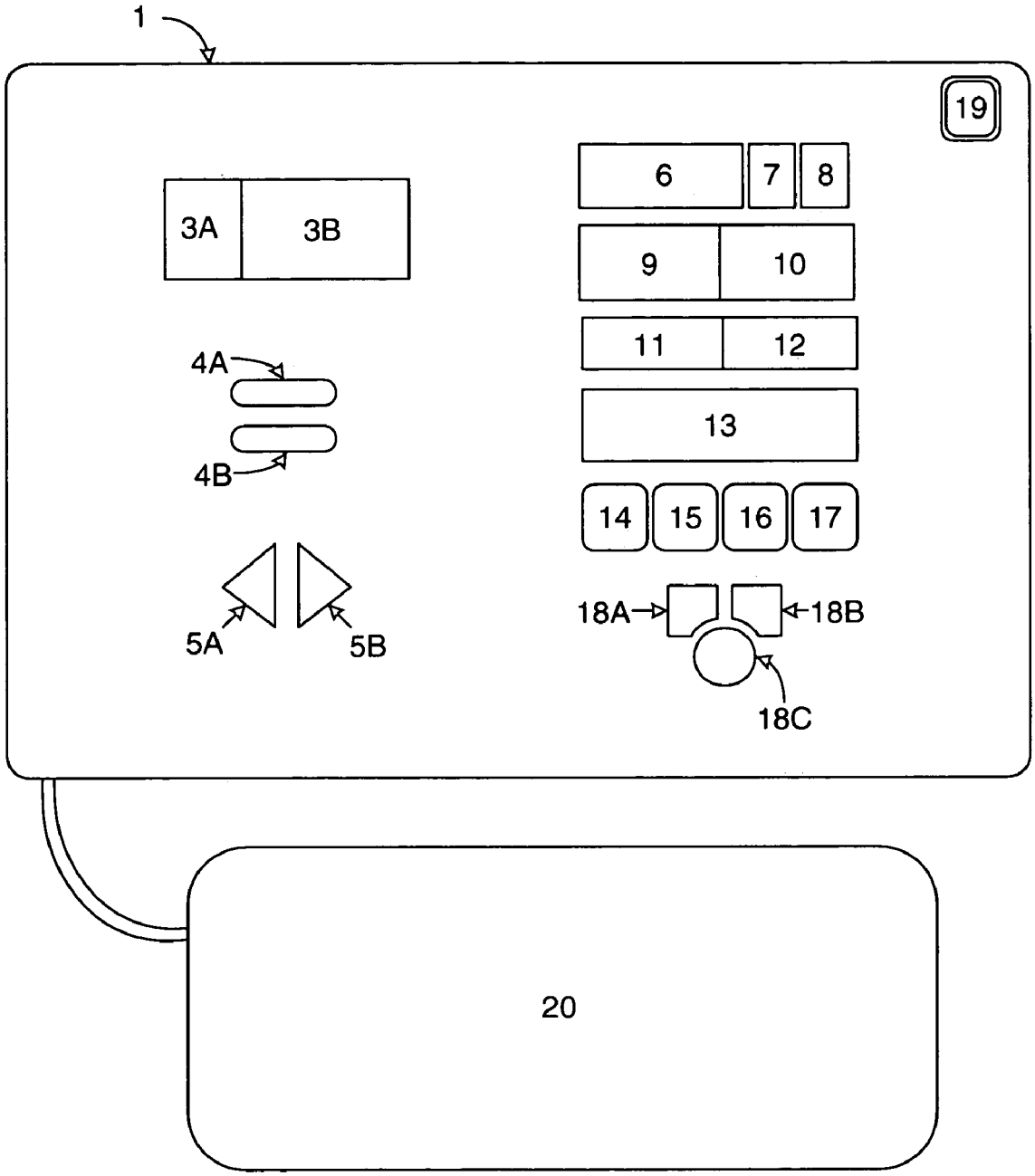
FIG. 16 shows an alternative exemplary embodiment of the viewable top of the Integrated Information Presentation Device ("PowerPodium") according to this invention.

A fifth exemplary embodiment, shown in FIGS. 15 and 16, shows another possible configuration of the Integrated Information Presentation Device 1. In FIG. 15 showing the front view of this configuration, the screen is embedded in the cover of the Integrated Information Presentation Device, not unlike laptop configurations. This allows larger buttons, more buttons, or even the keyboard layout to be included on the viewable top surface of the Integrated Information Presentation Device. This particular embodiment of the Integrated Information Presentation Device shows the unit as an inseparable unit, in which the processor, removable storage units, interface cables/connections, and the speaker's functions are contained in one physical unit. This configuration is desirable in situations in which equipment is moved extremely frequently, or where inexperienced speakers or technicians must frequently set up the Integrated Information Presentation Device. The screen 2 (whether touch-sensitive or passive) in this embodiment may be configured to have a live-feed image of the speaker 2C, the speaker's notes and slides 2A, and the message center 2B. In this fifth embodiment, the viewable top surface of the Integrated Information Presentation Device is shown in FIG. 16. In this configuration, the buttons on the viewable top surface of the Integrated Information Presentation Device are enlarged, for example, for visually impaired speakers, or multi-lingual labels for buttons. Alternatively, many buttons could be added to enable control of more devices throughout the speaker's environment, or throughout the environments of any audience viewing the presentation over an Internet or other connection. For example, one set of buttons control a remote environment for an audience in New York City, while another set controls the environment where you are, say Los Angeles. The same or different Internet or other data connection that is used to send the speaker image could be used to send commands from one the Integrated Information Presentation Device to the other. Also, this configuration could enable the keyboard to be included in the top surface of the device, rather than as a removable device. This feature is desirable in situations in which the Integrated Information Presentation Device is used to input speaker presentation information directly into the Integrated Information Presentation Device or in situations in which the Integrated Information Presentation Device is used to access many web pages where text input is necessary. This configuration is also desirable in situations where the Integrated Information Presentation Device is highly portable, so that there are fewer components of which to keep track.

A sixth exemplary embodiment of the Integrated Information Presentation Device would enable the display of data or images transmitted to and/or from meeting participants at remote locations via devices such as, for example, whiteboards, scanners, and printers. This embodiment would also enable participants supplied with appropriate technology to have notes, diagrams, or images they produce before or during discussions to be viewed by the speaker immediately in a remote location. This embodiment would enable any other participant at any location involved in the conference to view notes, diagrams, and drawings in real time. This embodiment enables a speaker or participant to address any particular topic or answer a particular audience question and transmit not just his or her voice or video image, but any representations drawn on the board. This embodiment also enables any such sketches, diagrams, and text to be captured to be included in any transcripts, guides, or summaries of the presentation or conference. This can be accomplished numerous ways, from using a video camera to capture the board (and speaker) image to using a marker-tracking device to electronically track the color and positioning of markers as they mark on the board (sometimes called an Electronic Whiteboard). This embodiment enables a speaker or conference to use multiple whiteboards and the accompanying software to enable unique interactions, such as multiple speakers (and audiences) in various locations working together to solve a problem (sometimes also known as video conferencing), define a solution, or provide diagrams or explanations to complement what is being presented. An alternative embodiment provides a way for audience members (probably in more intimate settings, but not necessarily) to interact with an image, or even electronically "point" to a particular place on the display, if the capability to interact with handheld devices is available, through such means as, but not limited to, the Internet, an intranet, or wireless signal. As has been described in other embodiments, the speaker at the Integrated Information Presentation Device is able to control how and when these images and data are displayed on the speaker screen and the audience screen(s).

It is also understood that as other imaging technologies and transmission means become widely available that the Integrated Information Presentation Device could accommodate many of these quite easily.

Figure 17:
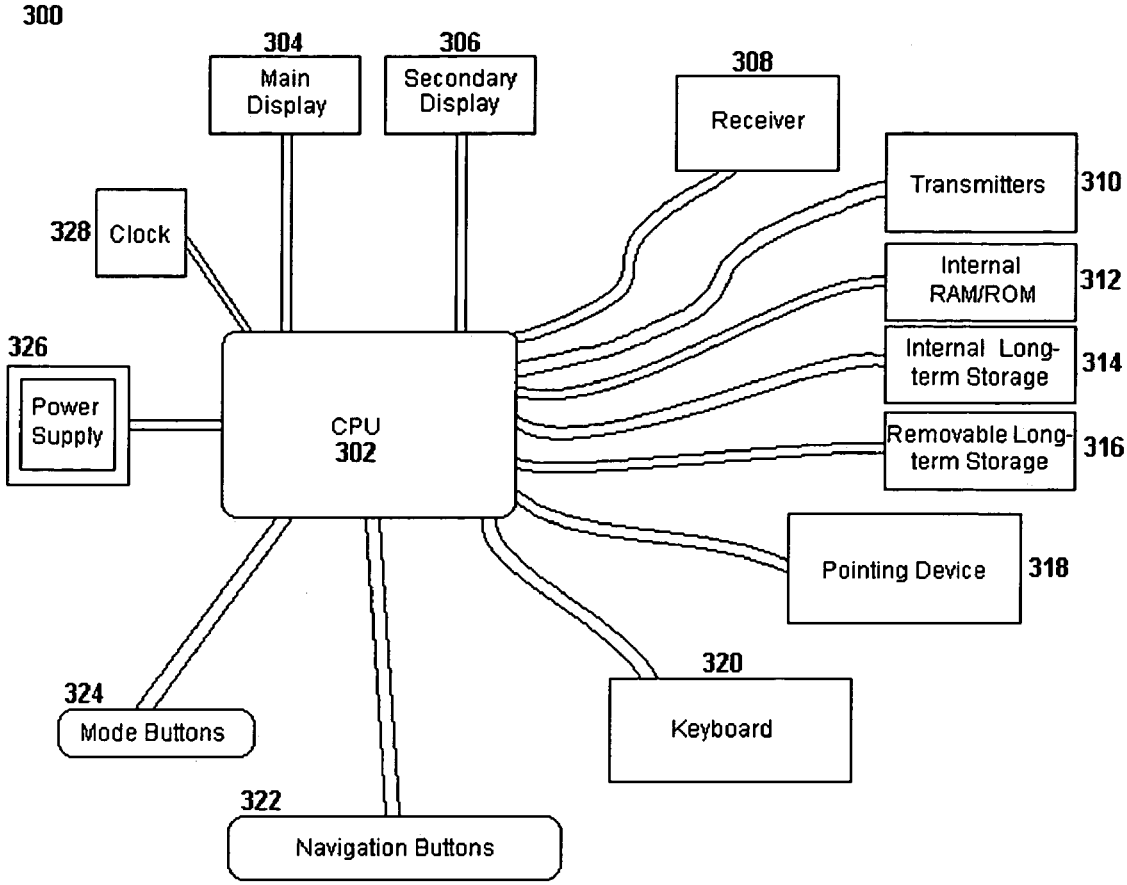
FIG. 17 shows the relationship of devices of the Integrated Information Presentation Device ("PowerPodium") with a central processing unit (CPU) according to this invention.

A seventh exemplary embodiment FIG. 17 of the Integrated Information Presentation Device 300 is presented. Comprising the seventh exemplary embodiment are the processing unit (CPU) 302, main display 304, secondary display 306, receiver 308, transmitters 310, internal RAM/ROM 312, Internal Long-term storage 314, Removable Long-term storage 316, pointing device 318, keyboard 320, navigation buttons 322, mode buttons 324, power supply 326, and clock 328. The processing unit receives inputs from the various devices, processes them, and produces signals to the appropriate output device.

The main display 304 would normally correspond to the display 2 of the Integrated Information Presentation Device, but not in every case, while the secondary display 306 may be, for example, a projector, a second screen on the Integrated Information Presentation Device, a separate screen on the wall, or even a screen thousands of miles away able to receive the output of the Integrated Information Presentation Device. The receiver 308 may be comprised of any device or set of devices capable of detecting electromagnetic radiation, whether through an electromagnetic conductor or a wireless signal, and converting it into data for the purpose of getting feedback or data from external devices. The transmitters 310 may be comprised of any device or set of devices capable of transmitting electromagnetic radiation, whether through an electromagnetic conductor or wireless signal for the purpose of sending commands or data to external devices.

The Internal RAM/ROM 312 would normally correspond to volatile memory chips, although it may correspond to non-volatile memory in some instances. The Internal Long-term storage 314 comprising for example, a hard drive, would be used for example, to store the presentation software and the agenda file organizer software. In contrast, the Removable long-term storage 316 comprising for example, a CD-ROM, would be used to load the specific presentation of various speakers to prepare for instance, for a conference.

The pointing device 318 comprising for example a mouse, a trackball, a lightpen, or head movement detector gives control over the cursor to allow the user to interface with graphical user interfaces (GUI's). The keyboard 320 allows alphanumeric data to be sent for processing by the processing unit (CPU) 302, used for example, to enter data about the speakers on a daily agenda or presentation data. The navigation buttons 322 comprise buttons which control the cursor, buttons which signal to execute a task such as advancing to the next slide, or buttons that are used to select appropriate files from a directory listing. The mode buttons 324 comprise for example, environmental adjustment buttons (for example lighting, temperature, air flow, etc.), shortcut mode buttons, Internet button, presentation button, black screen button, white screen button, and assistance required button. The power supply comprises a means for transmitting electrical energy from an energy source, such as, but not limited to, a battery, a wall outlet, a generator, or a solar panel, to the processing unit 302 through an electrical conducting material.

It is to be noted that as technology progresses, new interface, output, processing, computing devices, and input devices will be developed. The specific choices for hardware may be updated to reflect development in these areas.

Figure 19:
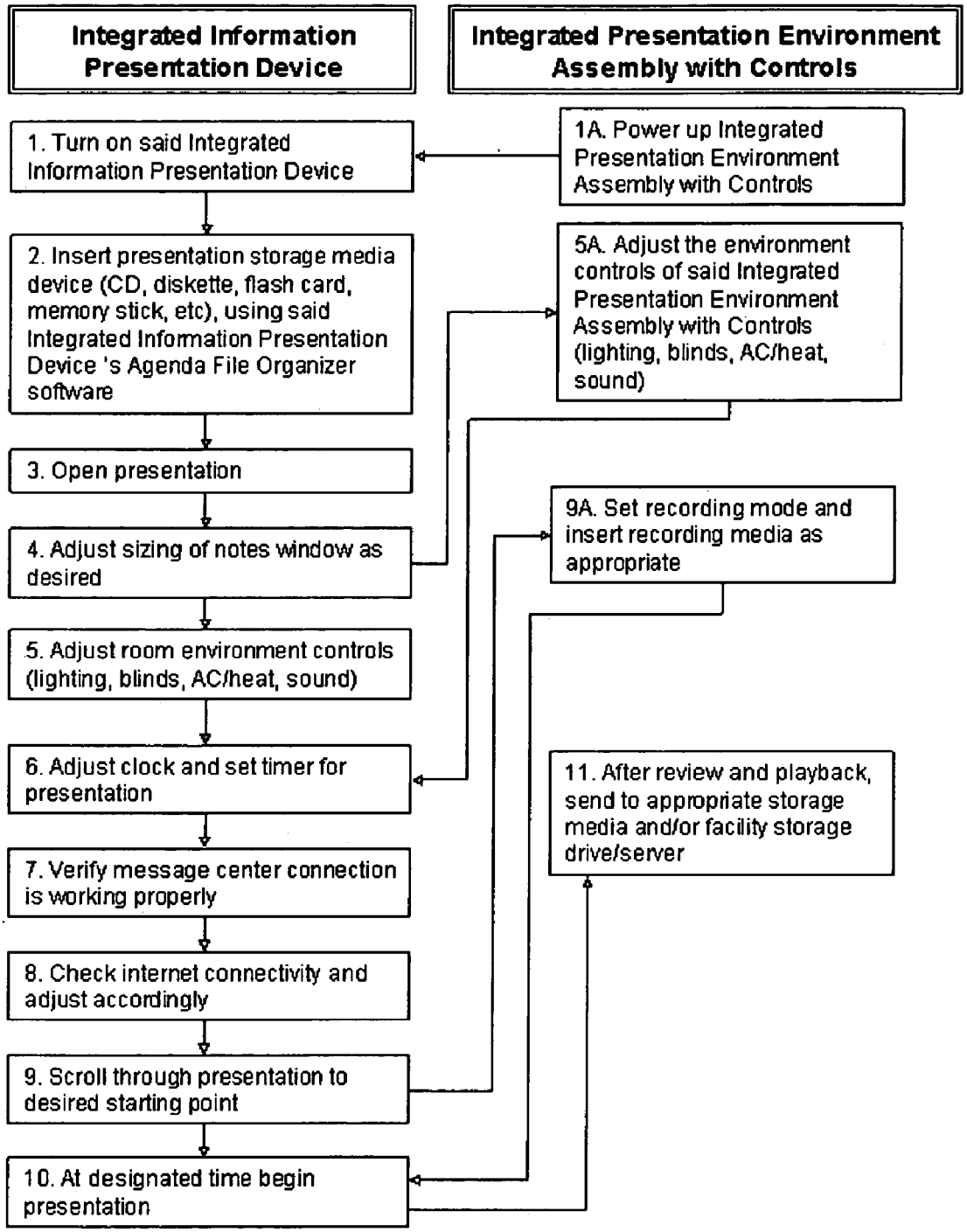
FIG. 19 shows one exemplary set of steps taken to set up the Integrated Information Presentation Device, with an alternate path but similar set of steps taken to set up the Integrated Presentation Environment Assembly with Controls according to this invention.

While there are numerous valid combinations of steps to set up the Integrated Information Presentation Device to be used to give a presentation, the following is a list of some of the steps a presenter might follow in the use of the Integrated Information Presentation Device to facilitate a presentation. These exemplary steps are illustrated in FIG. 19, attached.

1. Turn on the Integrated Information Presentation Device. Using telephone connection to audiovisual technical staff review preparations for presentation.
2. Insert media with presentation files into storage media device (CD, diskette, flash card, memory stick, etc.), using the Integrated Information Presentation Device's Agenda File Organizer software. Presentation file may have been edited prior to presentation utilizing Presentation Booth.
3. Open presentation file, check slides.
4. Adjust sizing of notes window as desired
5. Adjust room environment controls (e.g. lighting, blinds, AC/heat, sound)
6. Adjust clock and set timer for presentation.
7. Verify message center connection is working properly 8. Check, Internet connectivity and adjust accordingly, verify connection of any remote locations to the Integrated Information Presentation Device. Contributing presenters may participate using one or more presentation booths remotely connected to the Integrated Information Presentation Device.
9. Scroll through presentation file to desired starting point.
10. At designated time, begin presentation.

In addition, there are numerous valid combinations of steps to set up the Integrated Presentation Environment Assembly with Controls that can be utilized. The following is a list of some of the exemplary steps a presenter might follow in the use of the Integrated Presentation Environment Assembly with Controls. These steps are illustrated in FIG. 19, attached.

1A. Power up the Integrated Presentation Environment Assembly with Controls
1. Turn on the Integrated Information Presentation Device. Using telephone connection to audiovisual technical staff review preparations for presentation.
2. Insert presentation storage media device (CD, diskette, flash card, memory stick, etc.), using the Integrated Information Presentation Device's Agenda File Organizer software.
3. Open presentation, check slides.
4. Adjust sizing of notes window as desired
5A. Adjust the environment controls of the Integrated Presentation Environment Assembly with Controls (lighting, blinds, AC/heat, sound)
6. Adjust clock and set timer for presentation.
7. Verify message center connection is working properly
8. Check Internet connectivity and adjust accordingly, verify connection of any remote locations to the Integrated Information Presentation Device.
9. Scroll through presentation to desired starting point.
9A. Set recording mode and insert recording media as appropriate
10. At designated time, begin presentation.
11. After review and playback, send to appropriate storage media, and/or facility storage drive/server, and other devices by via Internet, wireless or other means.

The Integrated Presentation Environment Assembly with Controls is related to the field of Training Devices, Presentation Devices, and to the field of Computing Devices (commonly called computers). Exemplary systems and methods are discussed that provide a simulated environment, provide for the taping of the session, and enhance the ability of speakers to present high quality presentations.

An exemplary embodiment of the Integrated Presentation Environment Assembly with Controls solves a number of problems speakers presently encounter in meeting facilities.

Figure 9:
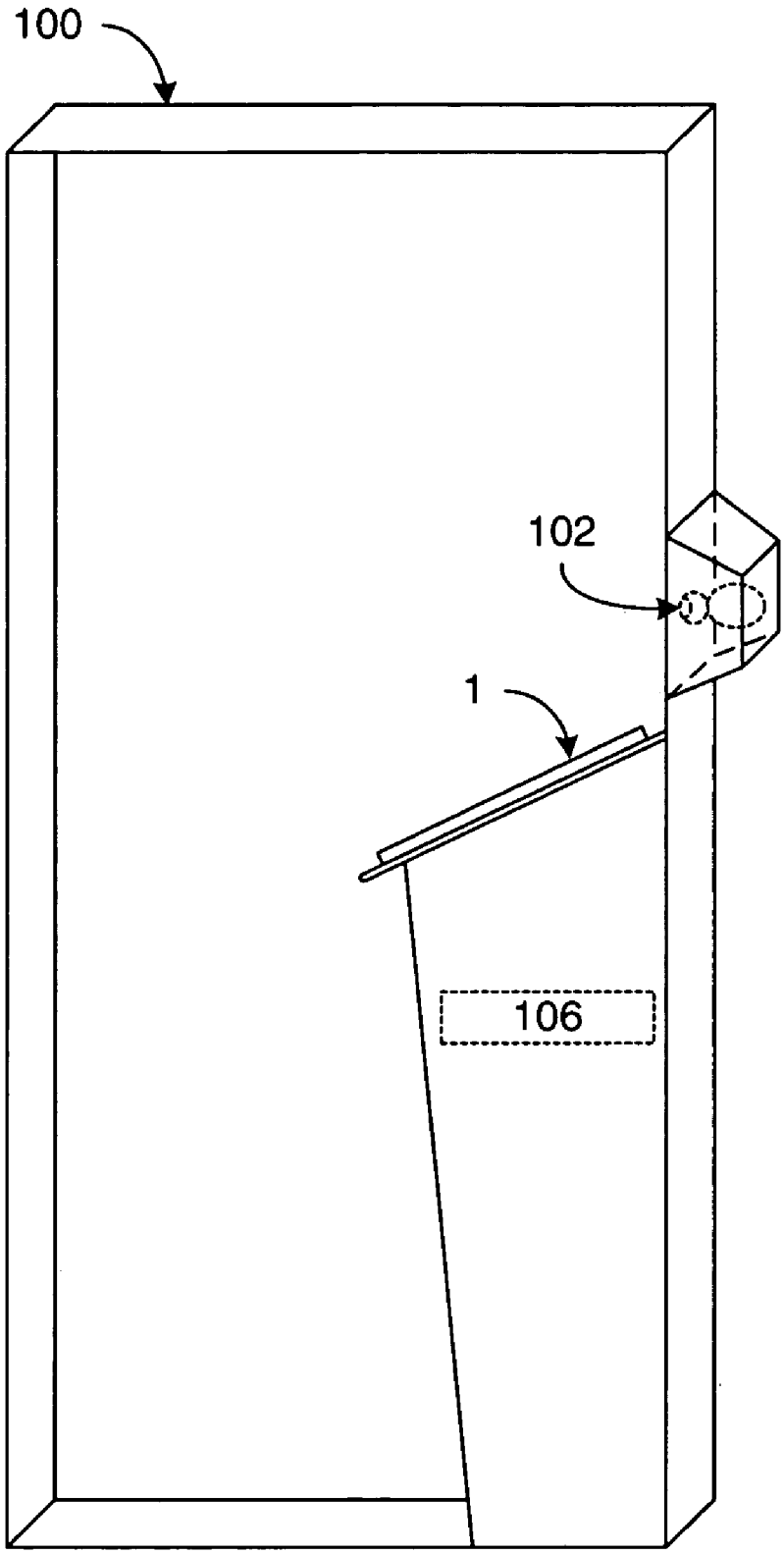
FIG. 9 shows a cut-away side view of one exemplary embodiment of the Integrated Presentation Environment Assembly with Controls ("Presentation Booth") according to this invention.
Figure 10:
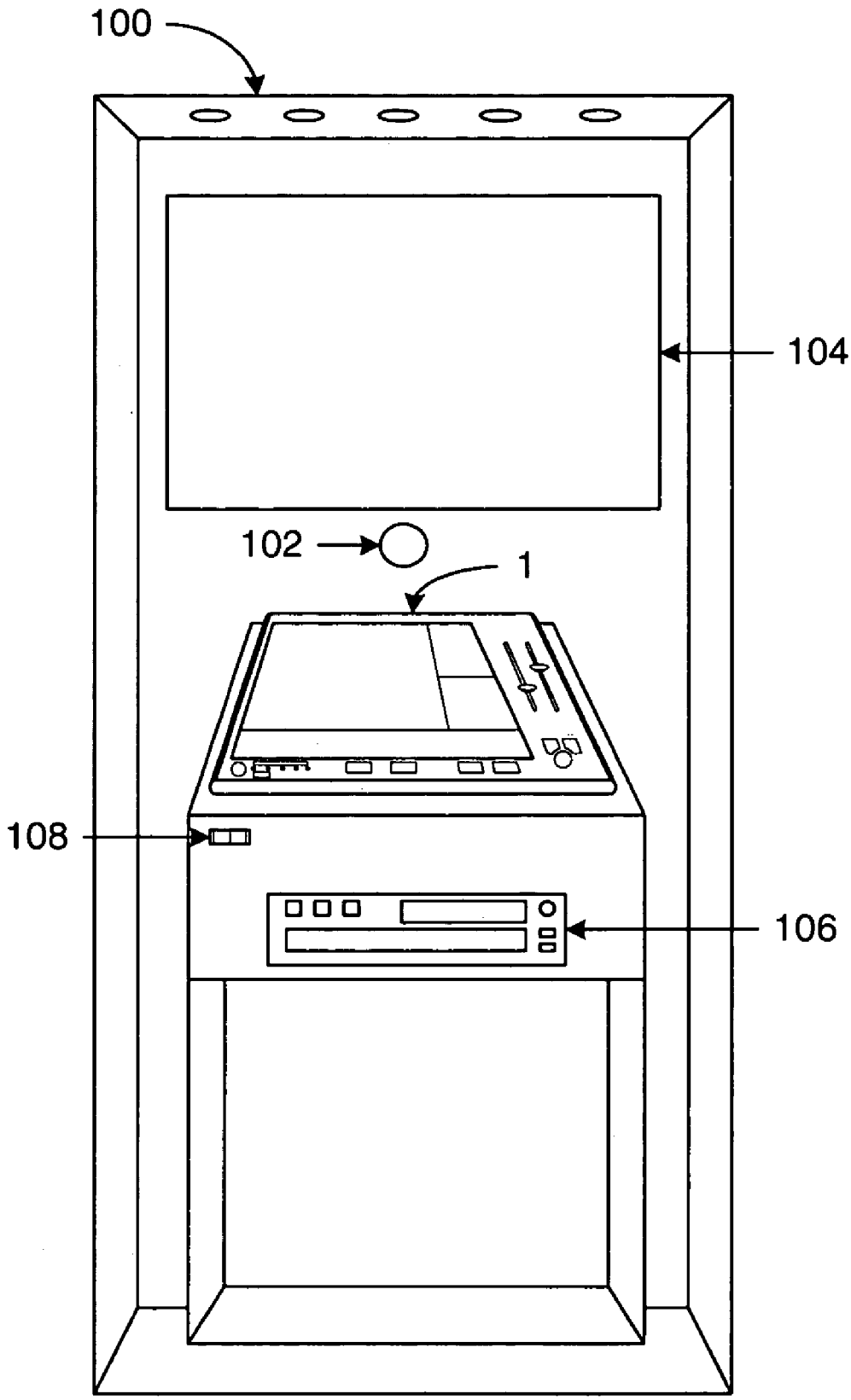
FIG. 10 shows a front view of one exemplary embodiment of the Integrated Presentation Environment Assembly with Controls ("Presentation Booth") according to this invention.

One exemplary implementation of the Integrated Presentation Environment Assembly with Controls is seen in FIGS. 9 and 10. FIG. 9 is a "cut-away" side view showing a speaker during a practice session. The speaker may stand during the session or may sit on a chair (such as, but not limited to, a "bar-stool" chair). To activate the unit, a main power switch 108 is switched on to power the screen 104, the camera 102, and the PowerPodium device 1 (and video recording/playback unit 106, if applicable). Lighting from the ceiling of the Integrated Presentation Environment Assembly with Controls illuminates the PowerPodium. The Integrated Presentation Environment Assembly with Controls may have, for example, a door or a curtain which can be shut/drawn to shield the speaker from external noise and light, or it may be an open unit if it is located in a low-traffic area. A set of headphones, other listening device, or other sound-retarding device may be given to the speaker in high-traffic areas to enable better concentration. If an enclosed unit is used, airflow regulators may be used to keep the environment suitable for use.

Another exemplary implementation of the Integrated Presentation Environment Assembly with Controls comprising the Integrated Information Presentation Device and the Integrated Presentation Environment Assembly with Controls. The Integrated Presentation Environment Assembly with Controls would act similarly to a docking station commonly used with laptops, with the Integrated Information Presentation Device interfacing with it. The Integrated Presentation Environment Assembly with Controls may have various actual environmental controls and/or the means to simulate various environmental controls, with all the appropriate connections to simulate and control the entire presentation area, or it may have a minimal number of connections (video out, etc). Because the Integrated Information Presentation Device is removable in this and similar embodiments, the same physical device could be used both in the Integrated Presentation Environment Assembly with Controls and in the presentation room.

When the Integrated Presentation Environment Assembly with Controls is installed at a location, a technician or facility employee is able take a picture of each of the available presentation rooms for use in the Integrated Presentation Environment Assembly with Controls. The pictures can be taken with a full audience if convenient, or it can be of the empty rooms. Minimally, a printout or developed shot can be mounted opposite the speaker in the Integrated Presentation Environment Assembly With Controls. In an alternative embodiment of-the Integrated Presentation Environment Assembly with Controls, an Audience Simulation Display 104 such as, but not limited to, a video screen, capable of displaying an image, is used to display a static picture of an environment, with or without an audience, that approximates the atmosphere of the room the speaker will be using, for example, a generic classroom or auditorium. In a slightly more sophisticated setup, with a screen 104 capable of displaying visual images, a digitized static picture of the available rooms, with or without an audience, taken by a technician or facility employee the presenter can be displayed on the screen. This will enable the speaker to choose a setting that most closely matches the location of his or her presentation to provide a more authentic atmosphere. A technician may load an array of appropriate pictures in the display apparatus for selection by the speaker. Thus, when the speaker looks forward in the Integrated Presentation Environment Assembly with Controls, he or she will see a simulated audience (or at least the arrangement of seats). This feature may be enhanced in by having a video of a real audience (as opposed to a still picture) in a generic room or an actual facility room, or even an interactive audience (this may necessitate another software program to be loaded, not unlike some interactive video games) to provide as realistic an experience is possible. It is appreciated that as technology continues to advance, the simulated audience can continue to be more sophisticated, for example, a full audience with each member having different personalities, preferences, and backgrounds. When used to train speakers, an advanced simulated audience could have various scenarios ranging from 'pleasant' to 'disaster,' allowing the speaker to think through situations well before facing them in front of a live audience.

Once the Integrated Presentation Environment Assembly with Controls is activated and the speaker adjusts his seating and any materials he needs, the speaker will load his presentation file into the Integrated Information Presentation Device (Alternatively, the speaker's presentation may be already loaded into the Integrated Information Presentation Device by the site technician. If not, the speaker will need to load the presentation using one of the various removable media devices and software programs provided.). If the speaker desires to video tape this practice session, the Video Recording Unit 102 (for example, a Video Camera) can be started and the presentation can commence. During the practice presentation, the speaker can control the paging of slides in the same manner he would control them during the real presentation. Various combinations of features can be "activated" in a particular implementation of the Integrated Presentation Environment Assembly with Controls (also known as a Presentation Booth) at the time of purchase, or perhaps in an upgrade later on. The integrated environmental controls, which are integrated into the circuitry of the Integrated Presentation Environment Assembly with Controls, simulate (as much as can be simulated in a phone booth sized space) the control of the presentation environment. With an interactive Audience Simulation Display, you can control the "virtual lights," the "virtual shades," audience microphones, and speaker controls, just as you would in the presentation room. The messages the speaker might receive from an assistant during the presentation through the message center can be simulated through software, though the speaker would see no difference on the Integrated Information Presentation Device. The speaker could also practice using the remote control or any of the other peripheral devices as well.

Other uses of this invention include testing and training speakers while at seminars, classes, or forums on speaking, and providing a compact environment to record presentations on tape or transmit presentations over the Internet in situations where the speaker does not have an audience physically present with him. Multiple instances of the Integrated Presentation Environment Assembly with Controls may be used in a currently under-utilized area in the building (like a small basement room), enabling the facility to offer more features to their customers and better utilize their existing building space.

The exemplary Integrated Presentation Environment Assembly with Controls 100 may include, but is not limited to, the following elements:

A compartment 106 of adequate size, optionally with dimensions equal to a standard phone booth, or 1½ times the size of a phone booth. The compartment may be enclosed, partially enclosed, or open, and it may have doors, curtains or other means to provide more privacy or sound deadening. The compartment may have limited structural walls, similar to some models of payphones with limited privacy. Minimally, the compartment may be nothing more than an area next to the Integrated Information Presentation Device, video camera, and Audience Simulation display mounted on a wall or even a movable partition.

A main power switch 108 which turns on all electronic equipment in the Integrated Presentation Environment Assembly with Controls.

A Video camera 102, which may focus on head and shoulders only, zoom in for a close-up view of the speaker's face, or may provide a wide-angle view of the speaker. It is to be understood that as advances are made in image recording technology, they are easily incorporated herein.

An audience simulation display 104, comprising a static picture, a video display unit, or an advanced image display. It is to be understood that as advances are made in display technology, they are easily incorporated herein.

The Integrated Information Presentation Device 1, mounted in a podium, on a shelf, or other means of support, resting on a podium, shelf, or other means of support, or supported by other means which allow proper usage of the device.

A video recorder or video playback unit 106, comprising a device similar to what is commonly known as a VCR (Video Cassette Recorder). The video playback unit may be used in conjunction with the video camera to record the presentation, or it may be used to play a previously recorded presentation.

Various real and simulated environmental controls to simulate the presentation room environment as closely as possible. The environmental controls include, but are not limited to, lighting, temperature, air flow, sound, and any, all, or none of these may be simulated instead of actual.

Thus an exemplary Integrated Presentation Environment Assembly with Controls 100 would have a working PowerPodium device 1, video camera 102, a display 104, Video Playback Unit 106, and a main power switch 108.

Figure 11:
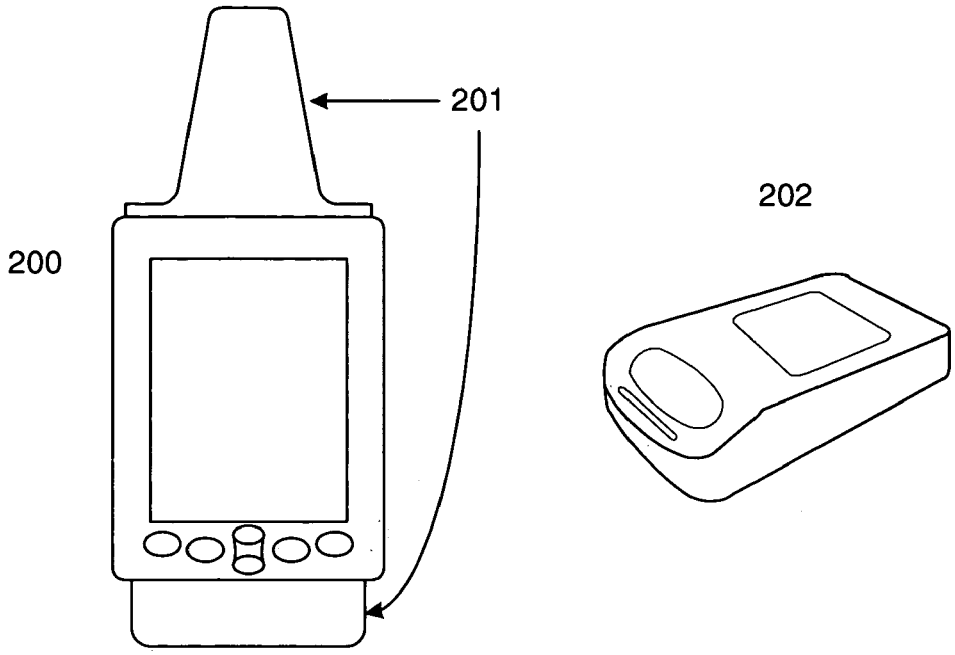
FIG. 11 shows an exemplary personal handheld computing device according to this invention.

The speaker can utilize the Integrated Presentation Environment Assembly with Controls sitting down or standing, as in FIG. 11.

The speaker may have various levels of control over the simulated presentation environment and audience. This level of control may range from choices of static pictures of audience settings (classrooms, conferences, etc.), to fully simulated audiences with individual simulated people being controlled by using artificial intelligence simulation programs or algorithms. The Integrated Presentation Environment Assembly with Controls may also be integrated in such a way as to enable the environmental controls of the Integrated Information Presentation Device to interface with similar devices within the Integrated Presentation Environment Assembly with Controls (lights, air flow, etc) to provide a realistic experience for the speaker.

A video recording/playback unit 106, such as, but not limited to a VCR (Video Cassette Recorder), is accessible to the speaker for recording a practice session using the camera 102. This device may be unnecessary if the camera directly holds the recording tape. It may be desirable to have this unit since many cameras use different size tapes than many playback units commonly use. This unit could also be used to give immediate feedback to the speaker, although if demand for the Integrated Presentation Environment Assembly with Controls is high (or the cost per hour is high), the speaker may desire to take the video cassette to another video playback unit, such as in his hotel room. Depending upon the hotel's technological capabilities, the video may be made available to the speaker and/or others the speaker or conference may designate via the Internet or the hotel's internal network, to which the VCR may be connected.

An exemplary embodiment of the Personal Handheld Computing Device Presentation System to Interact with Various Projection Devices with many features is described. In particular, the Personal Handheld Computing Device Presentation System to Interact with Various Projection Devices comprises a transmitter 201, shown connected to a generic handheld computing device 200 in FIG. 11, a receiver base 202, and software is described.

An exemplary embodiment of the Personal Handheld Computing Device Presentation System to Interact with Various Projection Devices is shown in FIG. 11. In this figure, the speaker's Handheld Computing Device 200 is shown attached to the transmitter 201. The receiver base 202 is physically separate from the transmitter 201, which provides mobility to the speaker. While the transmitter 201 could be connected to the receiver base 202 through a long cable, it is more desirable to use wireless technology for communication. The Handheld Computing Device 200 may be the speaker's personal property or the property of the speaker's employer (although it need not be so, if the conference center provides a way to load his presentation on it), and since many handheld computing devices currently have incompatible interface ports, it may also be desirable for the speaker to own his or her own transmitter. This need not be mandatory, if the conference center either chooses a standard transmitter, or if it provides multiple types of transmitters. Handheld Computing Devices (a.k.a. Palmtops, PDA's, Pocket Computers, etc.) are becoming increasingly more popular, especially as more useful programs are written for them. These devices are often used by business people to keep track of a list of contacts, a schedule of appointments, and e-mail. Since it is becoming increasingly common for traveling business people to have such devices, personalized to their liking, this new functionality would leverage the previous investment in Handheld Computing Devices. By enabling speakers to come to a site with a small package consisting of a Handheld Computing Device, a receiver base, and removable media containing presentation files, the burden of packing larger and more numerous devices is reduced greatly. If a speaker uses his or her own handheld computing device to present information, there is little or no training time, even if the facility has never been visited before.

The software portion of the Personal Handheld Computing Device Presentation System to Interact with Various Projection Devices will have various implementations to enable compatibility with popular handheld computing device operating systems, such as, but not limited to, Palm OS™ and Windows CE™. The software running on the Personal Handheld Computing Device Presentation System to Interact with Various Projection Devices will communicate with the external receiver base 202 by means of an electromagnetic transmission connection (the transmitter 201), such as, but not limited to, an RF connection, infrared port, or even a physical wire. Because of the mobility it gives the speaker, a wireless connection is more desirable.

The external receiver base 202 will receive the signal from the Handheld Computing Device 200 and transmit it to the projection device to be displayed to the audience. If electromagnetic radiation (such as radio waves) is used, care must be taken to ensure that one instance of the Personal Handheld Computing Device Presentation System to Interact with Various Projection Devices used in one presentation room does not interfere with another instance of the Personal Handheld Computing Device Presentation System to Interact with Various Projection Devices in the vicinity. This situation is avoided, for instance, by using varying frequencies or "activation strings" at the beginning of messages, among other techniques. If the receiver base 202 is owned by the conference facility, it is desirable for it to have the capability of selecting various frequencies to receive, thus giving more flexibility to those speakers who bring their-own transmitters.

The use of the Personal Handheld Computing Device Presentation System to Interact with Various Projection Devices will enable a speaker to, for example, utilize the "primary" functions (i.e. speaker notes, current slide thumbnail, next slide thumbnail, slide sorter view, etc) of the Integrated Information Presentation Device (PowerPodium) on systems which do not have the Integrated Information Presentation Device installed. The Personal Handheld Computing Device Presentation System to Interact with Various Projection Devices will also be preferred in situations in which the infrequency of presentations, small audience size, or limited budget makes purchasing a full Integrated Information Presentation System With Environmental Controls or even the Integrated Information Presentation Device impractical.

Navigation during the presentation is accomplished by means of a stylus 24 upon the touch-screen of the handheld computing device 200. The stylus included with most Handheld Computing Devices may be used, if supplied; however, the stylus provided with the Integrated Information Presentation Device or Integrated Information Presentation System With Environmental Controls would be more advantageous to a speaker since it is equipped at one of its ends with a laser pointer.

Another exemplary embodiment of this device comprises pre-loading the presentation software and possibly the presentation data, on the receiver base 202 or even the projection unit. In this embodiment, the signals between the transmitter 201 and the receiver base 202 may comprise, for instance, navigation commands and commands to display, hide, select or move various items/slides during the presentation. This requires, despite any differences between them, the data and presentation software on both devices to be similar enough in appearance and function, or at least to use a common protocol, to enable the speaker to effectively communicate his presentation to the audience.

Optionally, a stylus FIG. 7, #24 enables the speaker to interact with the presentation screen, enabling, for example, notes to be "written" on the slides during the presentation. One possible embodiment of this device is a "dumb stylus," which is used on a pressure sensitive or field feedback screen. Another embodiment is a "smart stylus" 67 which "reads" the part of the screen it is tracing and transmits this information back to either the receiver base 202 or handheld computing device through the transmitter for processing. A laser pointer device 70 may be embedded in the other end of the stylus 24, the embedded laser pointer device 70 being activated or deactivated by the rotating of one end 69B of the stylus 24 about the rotational switch 69A, or a switch activated by the pressing of the clothing clip 68 on the side of the stylus 24.

Optionally, an interface enables the speaker to access the Internet through either a physical wire or a wireless signal. Additionally, since some Handheld Computing Devices already have wireless connections to the Internet, it may be desirable to give the speaker a short-term Internet account to connect through the wireless connection for use in the presentation.

An exemplary embodiment of the Integrated Information Presentation System With Environmental Controls comprises of the Integrated Information Presentation Device (also known as a PowerPodium), the Integrated Presentation Environment Assembly with Controls (also known as a Presentation Booth), the Personal Handheld Computing Device Presentation System to Interact with Various Projection Devices, the stylus, and the remote control.

Figure 18:
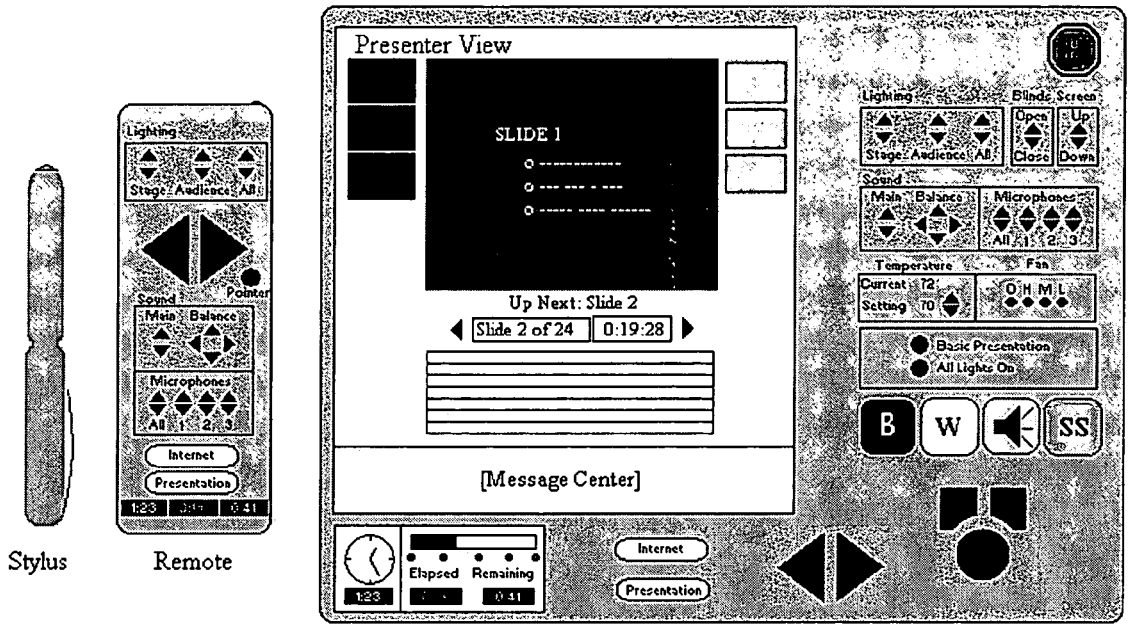
FIG. 18 shows an exemplary embodiment of the viewable top of the Integrated Information Presentation Device ("PowerPodium") according to this invention.

A second exemplary embodiment of the Integrated Information Presentation System With Environmental Controls is shown in FIG. 18, comprising the stylus, the remote control, and the Integrated Information Presentation Device. Using this embodiment, the speaker will have all the functionality of an exemplary embodiment of the Integrated Information Presentation Device, the maneuverability provided by the use of an exemplary embodiment of the remote control, and the ability the select on a touch-screen and highlight on the audience screen using an exemplary embodiment of the stylus.

A minimal embodiment of the Information Presentation System With Environmental Controls comprises the Integrated Information Presentation Device.

An alternative minimal embodiment of the Information Presentation System With Environmental Controls comprises the Integrated Presentation Environment Assembly with controls.

An alternative minimal embodiment of the Information Presentation System With Environmental Controls comprises the Personal Handheld Computing Device Presentation System to Interact with Various Projection Devices.

The above-described presentation system can be implemented on a special purpose computer or on a separate programmed general purpose computer having a communications device. Additionally, the systems and methods of this invention can be, implemented on a special purpose computer, a programmed microprocessor or microcontroller and peripheral integrated circuit element(s), an ASIC or other integrated; circuit, a digital signal processor, a hard-wired electronic or logic circuit such as discrete element circuit, a programmable logic device such as PLD, PLA, FPGA, PAL, or the like. In general, any device capable of implementing a state machine that is in turn capable of implementing the flowcharts illustrated herein can be used to implement the various methods according to this invention.

Furthermore, the disclosed methods may be readily implemented in software using object or object-oriented software development environments that provide portable source code that can be used on a variety of computer or workstation platforms. Alternatively, the disclosed system may be implemented partially or fully in hardware using standard logic circuits or VLSI design. Whether software or hardware is used to implement the systems in accordance with this invention is dependent on the speed and/or efficiency requirements of the system, the particular function, and the particular software or hardware systems or microprocessor or microcomputer systems being utilized. The systems and methods illustrated herein however can be readily implemented in hardware and/or software using any known or later developed systems or structures, devices and/or software by those of ordinary skill in the applicable art from the functional description provided herein and with a general basic knowledge of the computer and communications arts.

Moreover, the disclosed methods may be readily implemented in software executed on programmed general purpose computer, a special purpose computer, a microprocessor, or the like. In these instances, the systems and methods of this invention can be implemented as program embedded on personal computer such as JAVA® or CGI script, as a resource residing on a server or graphics workstation, as a routine embedded in a dedicated system, or the like. The system can also be implemented by physically incorporating the system and method into a software and/or hardware system, such as the hardware and software systems of a presentation server.

It is therefore apparent that there has been provided, in accordance with the present invention, systems and methods for enhanced presentation presenting. While this invention has been described in conjunction with a number of embodiments, it is evident that many alternatives, modifications and variations would be or are apparent to those of ordinary skill in the applicable arts. Accordingly, it is intended to embrace all such alternatives, modifications, equivalents and variations that are within the spirit and scope of this invention.

We claim:

1. An information display system comprising:

a presentation device capable of displaying a presentation, maintaining status information and managing the functionality of:

an environmental control module adapted to adjust one or more environmental controls;

a messaging system capable of receiving messages from one or more audience members; and a detachable presenter unit that is at least capable of being in communication with the presentation device and is at least capable of controlling one or more functions of the presentation device; and a remotely located presentation booth that is adapted to emulate the functionality of the presentation device during a practice session for the presentation.

2. The system of claim 1, further comprising a broadcasting system that is capable of distributing the presentation to a plurality of locations.

3. The system of claim 1, further comprising one or more profiles that specify a particular set of environmental controls.

4. The system of claim 1, wherein the messaging system receives electronic messages from one or more audience members, one or more of these electronic messages being displayed in a messaging center.

5. The system of claim 1, further comprising one or more of an active or passive pointing stylus.

6. The system of claim 1, further comprising a presentation loading system adapted to receive one or more presentations from one or more of a recorded media, a wireless transmission, a wired transmission and a presentation booth.

7. The system of claim 1, wherein the presentation device comprises a primary screen and a secondary screen, the primary screen displaying a presenter view and the secondary screen displaying a presentee view.

8. The system of claim 1, further comprising a distributed network access device.

9. The system of claim 1, wherein the environmental controls comprise at least one of lighting controls, temperature controls, shade controls, volume controls, microphone controls, screen controls, fan controls and automated hardware controls.

10. The system of claim 1, further comprising a recording system.

11. The system of claim 1, wherein the environmental control module utilizes an identification scheme to identify specific environmental controls.

12. The system of claim 1, further comprising a detachable presenter locating device.

13. The system of claim 1, further comprising a personal digital assistant in communication with and adapted to control the information display system.

14. The system of claim 1, further comprising one or more of an assistance required button, an internet access button, a next slide button, a previous slide button, a skip to slide button, video camera control, web cam controls, telephone controls, remote environment adjustment controls, shortcut mode buttons and speakers notes displayed concurrently with slide information, with the speakers notes not being visible to an audience.

15. A presentation method comprising:

loading a presentation in a presentation device;

adjusting one or more environmental controls using the presentation device;

initializing a messaging system in the presentation device;

initializing a remote presenter unit using the presentation device;

practicing a presentation in a remotely located presentation booth, the presentation booth simulating the functionality of the presentation device; and presenting the practiced presentation at the presentation device.

16. The method of claim 15, further comprising starting a recording mode.

17. The method of claim 15, further comprising receiving electronic communications from one or more audience members.

18. The method of claim 15, further comprising accessing a distributed network from the presentation device.

19. The method of claim 15, wherein the environmental controls comprise at least one of lighting controls, temperature controls, shade controls, volume controls, microphone controls, screen controls, fan controls and automated hardware controls.

20. The method of claim 15, further comprising controlling aspects of the presentation with the remote presenter unit.

21. An information display system comprising:

means for displaying a presentation, maintaining status information and managing the functionality of;

means for adjusting one or more environmental controls;

means for receiving messages from one or more audience members; and means for remotely controlling one or more functions of the information display system; and means for remotely emulating the functionality of the means for displaying a presentation during a practice session for the presentation.

22. The system of claim 1, further comprising an agenda file organizer adapted to manage one or more documents associated with one or more presentations.

23. The system of claim 1, wherein the presentation booth utilizes one or more of hardware and software to replicate features of the presentation device.

24. The system of claim 23, wherein the presentation booth is adapted to transmit or receive a presentation to, or from, respectively, a remote location.

25. The system of claim 23, wherein the presentation booth is geographically remote from the information display system.

26. An information display system comprising:

a presentation device capable of displaying a presentation and maintaining status information;

an environmental control module adapted to adjust one or more environmental controls;

a detachable presenter unit that is at least capable being in communication with the presentation device and is at least capable of controlling one or more functions of the presentation device;

a presentation booth replicating the functionality of the presentation device, the environmental control module and the detachable presenter unit.

27. An information display system comprising:

a presentation booth adapted for practicing a presentation; and a power podium in communication with the presentation booth and for presenting the presentation, each being adapted to:

display the presentation and maintain status information;

adjust one or more aspects of a presentation environment;

receive one or more presentations; and organize the one or more presentations in accordance with an agenda file organizer.

* * * * *